United States Patent [19]

Dompas

[11] 4,035,966

[45] July 19, 1977

[54] STRUCTURE HAVING VERTICAL BEARER WALLS AND HORIZONTAL CEILINGS

[76] Inventor: Leon Eugenie Daniel Dompas, 213 Van Rijswijcklaan, Antwerp, Belgium

[21] Appl. No.: 725,766

[22] Filed: Sept. 23, 1976

Related U.S. Application Data

[63] Continuation of Ser. No. 515,802, Oct. 17, 1974, abandoned.

[30] Foreign Application Priority Data

Oct. 18, 1973 Germany ..... 2352250

[51] Int. Cl.[2] ..... E04B 1/06; E04B 1/348; E04A 21/14

[52] U.S. Cl. ..... 52/73; 52/79.1; 52/9 D

[58] Field of Search ..... 52/79.8, 79.13, 79.9, 52/73, 90, 91, 227, 228, 223

[56] References Cited

U.S. PATENT DOCUMENTS

| | | | |
|---|---|---|---|
| 1,553,158 | 9/1925 | Henderson | 52/227 X |
| 2,691,291 | 10/1954 | Henderson | 52/79.9 |
| 2,874,812 | 2/1959 | Clevett | 52/227 |
| 3,553,923 | 1/1971 | Dompas | 52/79 |
| 3,559,361 | 2/1971 | Sarros | 52/743 |
| 3,722,158 | 3/1973 | Dykmans | 52/220 X |

FOREIGN PATENT DOCUMENTS

| | | | |
|---|---|---|---|
| 841,888 | 1/1939 | France | 52/9 D |

*Primary Examiner*—John E. Murtagh
*Attorney, Agent, or Firm*—Alan H. Levine

[57] ABSTRACT

A structure comprising a plurality of self-supporting frame parts. Each frame part comprises interconnected vertical and horizontal strips. The elements composing the strips are all bound together by pull ropes. The frame parts are aligned and bound together with tension wires so that the aligned vertical strips form bearing walls and the aligned horizontal strips form ceilings. The lowermost aligned horizontal strips may form the foundation floor of the structure.

19 Claims, 48 Drawing Figures

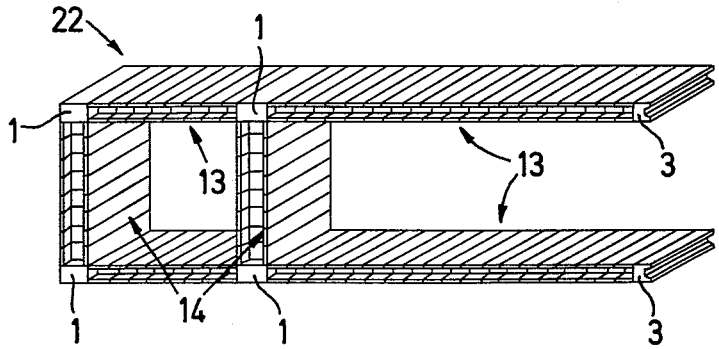
FIG. 4b
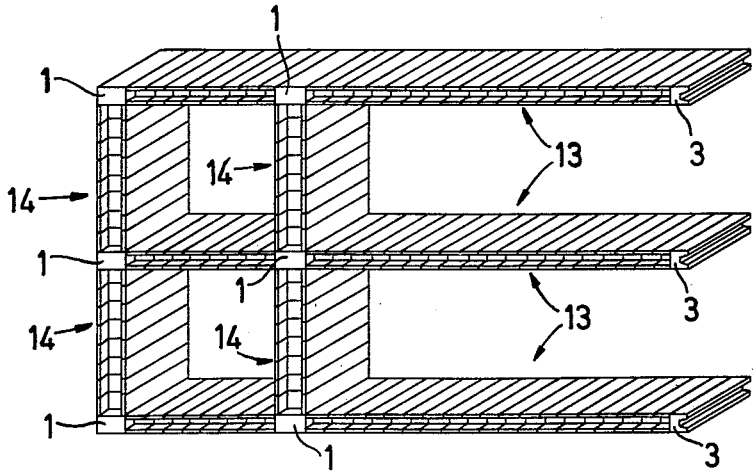

FIG. 8a
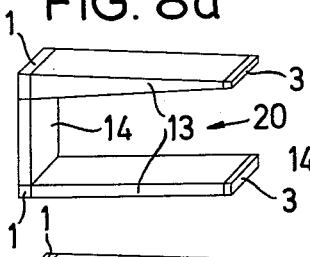
FIG. 8b
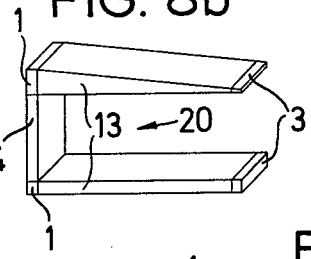
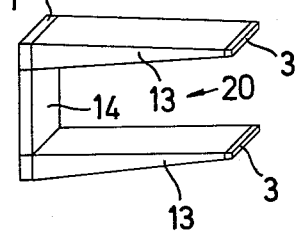
FIG. 8c
FIG. 8d
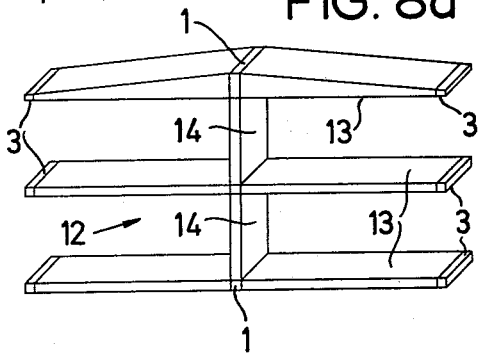
FIG. 8e
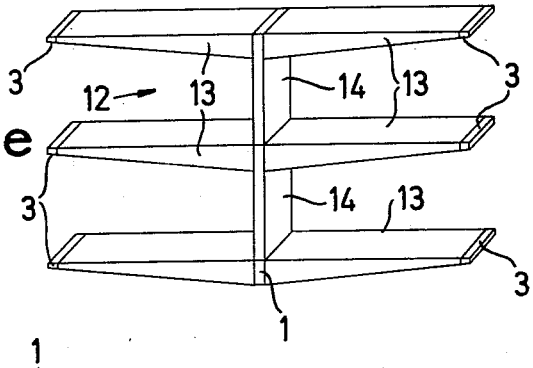
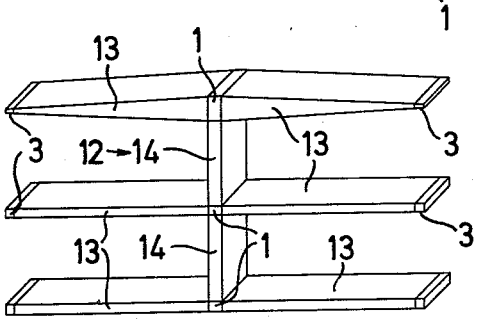
FIG. 8f

STRUCTURE HAVING VERTICAL BEARER WALLS AND HORIZONTAL CEILINGS

This application is a continuation of application Ser. No. 515,802, filed Oct. 17, 1974 now abandoned.

The invention relates to a structure having substantially vertical bearer walls and horizontal ceilings, the latter separating the floors from one another and forming the foundation floor.

It is generally known to erect structures so that after the provision of the foundations, basements or cellar rooms with the covering-in cellar ceiling, structural components of various shapes are joined together to form the (where necessary) intermediate walls and the outer walls enclosing the structure. When the walls have reached the height of the story horizontal ceilings are produced which are supported on the walls and subsequently, by building thereon, new walls are erected and ceilings incorporated until the desired height of the structure is reached. It is also known to produce relatively large wall and ceiling parts as prefabricated parts and to join them together into a structure by using mortar or concrete. In this case, only such prefabricated parts may be used as do not exceed a definite size and a definite weight, since they cannot otherwise be transported to the building site. Furthermore, it is a disadvantage that despite the use of prefabricated parts, the erection of a structure takes a long time. In order to provide a structure by these methods, furthermore skilled labor is necessary so that by reason of the relatively high hourly wage of such labor, it is inevitable that the structure will carry a high costs burden. Since the walls and ceilings of the structure are combined into one unit and consist of materials which can accommodate only minimal traction forces, such structures, as the foundation settles, tend to crack and with relatively considerable settling of the foundation and pronounced vibrations, for example during earth tremors, there is a danger of the building collapsing.

The object of the present invention is so to improve a structure of the above type in its structural design and with regard to its method of production, that the above disadvantages are avoided and so that, with minimal outlay and without calling upon a greater number of skilled workers, it is possible to provide a structure with simple means. In particular, it is intended to rely upon the structure remaining securely standing even under considerable settling of the foundation or during earth tremors without the danger of collapse.

This problem on which the invention is based is resolved in that the structure consists of self-supporting frame parts formed by vertical strips and horizontal strips and which, joined one to another, and possibly also joined one above another, and connected to one another horizontally by means of tensioning wires in groups or within the structure as a whole, the vertical strips of the frame parts being bearer wall strips and the horizontal strips being generally ceiling strips, and the lowest horizontal strips preferably forming the foundation floor for the structure. By reason of this tensioning of the frame parts among one another, there is an exact separation between compression-loaded and traction-loaded components. In this case, the tensioning wires have the task of absorbing the traction forces while the frame parts bear the compressive forces. By reason of this separation, the traction loaded components can be made from metal so that a high degree of tensile strength can be achieved. In consequence, structures which are so produced are unaffected by inadequate foundation and are insensitive to vibrations. The frame parts can be so constructed that they comprise all the — when viewed in cross-section — available parts of a structure, i.e. the foundation floor, the individual ceilings of the stories and the bearing parts of the roof or the complete roof. These frame parts can be so constructed that they can, without foundation, be set up on the earth once this has been merely levelled. In a further development of the invention, it is proposed that the bearing wall and ceiling strips consist of block and/or beam-shaped component parts which are all braced with respect to one another by means of pull ropes. At the points of intersection of the bearer walls and ceiling strips, nodal components are disposed while at the ends there are end components, these component elements having holes to receive the tensioning wires and pull ropes. This construction of the frame parts has the advantage that without extensive preparations, it is possible to produce frame parts of the most widely diverse forms. Only the length of the pull ropes which can be provided on reels or in lengths, has to be adapted to the length of the bearer wall or ceiling strips. The number of components incorporated between the nodal elements and the end elements determines the size and shape of the frame parts. The end components have recesses to receive pull rope and where applicable tensioning wire pre-stressing elements, these being constructed in accordance with the pre-stressing elements which are used in the case of pre-stressed concrete. According to the length of the bearer wall and ceiling strips, it may be favourable to dispose between the nodal and end components connecting components having holes for the pull ropes and possibly additional tensioning wires. Thus it is possible that the frame parts can be connected to one another by means of tensioning wires not only at the nodal and end components but also at components disposed between them, which may for example be particularly important for the ceiling strips which serve as a foundation floor. At the same time, many and varied connecting components can be incorporated in each bearer wall and ceiling strip. By reason of the construction of the invention, there is a sharp separation between the bearing and non-bearing component parts of a structure, such as is not the case with the hitherto known methods of building. In this respect, only the frame parts take over the bearing work, whereas the developer or the architect is left freedom to dispose separating components only where they are necessary for separation and to construct them in such a way that they only fulfill the separation function. Thus, by applying the present invention, it is possible for example for all the outside walls surrounding a house to be of glass over their entire height, since the frame parts fulfill all the bearing functions. Furthermore, the architect's task of providing building plans are considerably simplified since he no longer needs to survey the walls. It is necessary only to indicate the basic form of the frame parts and to indicate the separating walls. The number of component elements comprised in a frame part may correspond to the number of rectangles or squares in the structural plan.

Since the nodal, terminal and connecting component elements have, disposed approximately at right-angles to one another, holes to accommodate the pull ropes and tensioning wires, it is favourable to their durability for these to be constructed as solid blocks. The block and beam-shaped components disposed between these elements are best constructed as hollow profiled blocks. It is necessary only to ensure that they have cavities or holes or slots for the pull ropes. Otherwise, they can be made in any desired shape and size.

In the case of a relatively large number of identical bearer wall and ceiling strips, it may be favourable for the length of the beam-shaped components to correspond to the dimension between the nodal and connecting or terminal blocks. So that the block and beam-shaped components which are constructed as hollow profiled blocks may have small dimensions for ease of handling, it is suggested that there be adjacently disposed in the bearer wall and/or ceiling strips a plurality of mutually independent block or beam-like component elements in the direction of the tensioning wires, at least the nodal and/or terminal elements covering these component elements in the direction of the tensioning wires. By reason of the development of the frame parts according to the invention, this is possible since the pull ropes are anchored in the terminal components and only require to be guided for example in the nodal blocks so that the intermediately disposed block or beam-shaped component elements may be of any desired number or disposition since they are only loaded by compression. The terminal and/or nodal component elements act thereby in the manner of a thrust plate and distribute the forces of the pull ropes which are in theory applied spotwise, over the entire area of the bearer wall and ceiling strips. Since the pull ropes of the ceiling strips are guided not only in the terminal components but at least also in the nodal components or in the connecting components, it is easily possible for the pull ropes to be disposed along the ceiling strips in accordance with the pattern of bending moments. This means that for example in the case of a projecting ceiling strip, the pull ropes at the nodal blocks are disposed higher in a vertical direction than in the terminal components, so that the traction and/or compression forces are more favourably dispersed. Since the entire structure is dependent upon the strength of the pull ropes and tensioning wires, it is important for these to be incorporated in such a way that they are safeguarded against corrosion. This is particularly possible if the ropes or wires are disposed in holes or in relatively small recesses in the structural blocks, since then these holes or recesses can simply be filled in air-tight manner with an anti-corrosive composition or simply with concrete. If the pull ropes or tensioning wires are disposed in relatively large hollow cavities in the structural elements, then it is favourable for them to have an anti-corrosive coating consisting for example of synthetic plastics material. In this case, the safeguard against corrosion can also be produced by tube-like plastics sheaths being pushed over the pull ropes or tensioning wires, the space between the ropes or wires being for example sprayed with concrete. In order in the case of relatively large frame parts to simplify the erection of the frame parts and to achieve a (statically viewed) exact distribution of the forces in the bearer wall and ceiling strips, it is suggested that each bearer wall and ceiling strip have its own quite independent pull ropes. In order to be able to provide structures formed at will while using the greatest possible number of identical frame parts, it is suggested that the frame parts have a bearer wall strip at which unilaterally projecting ceiling strips are attached, the form of a recumbent "U" being produced by using two ceiling strips. With this basic frame shape, it is possible for example easily to provide small bungalow dwellings since they are usually single-storey buildings. But also larger dwelling installations can be provided with this basic frame form, since a plurality of such frame parts can be assembled to produce a structural group, these structural groups being so combined that they produce for example an atrium house. Another favourable basic frame shape is produced by the frame parts having a bearer wall strip and bilaterally projecting ceiling strips, the basic form with two ceiling strips corresponding to a recumbent "H". Similarly to the structural assemblies described above in the case of the U-shaped frame, a plurality of embodiments of structure can be provided using the same basic frame. A variation of the U-shaped and H-shaped basic frame part having relatively high strength properties can be achieved by the frame parts having two bearer wall strips disposed at an interval from and alongside each other in such a way that the projection of the ceiling strips is retained.

A particularly favourable and reliable attachment for the roof of the structure is achieved if the bearer wall strip or strips, in the case of individual or all frame parts, is or are extended above the topmost ceiling strips to receive a roof framework. This bearer wall strip part which is connected in conventional manner to the entire frame part via the pull ropes, is of considerable strength so that even with a small cross-section it can be used to accommodate the ridge and for the attachment of roof structures. This further development is particularly ideal if it is intended to use a roof structure which is made in conventional manner from wooden beams and the like. However, the present construction of the building also provides an opportunity, if the nodal blocks of the topmost ceiling strips have those faces which are directed towards the latter, inclined at an angle to the vertical, of using the topmost ceiling strips as roof surfaces so that they form one unit with and are produced simultaneously with the structure. In this case, no further parts are necessary since these topmost ceiling strips which serve as roof surfaces are connected in conventional manner via pull ropes to the topmost nodal component elements of the bearer wall strips. The ceiling strips can however also, for example if the ceiling strips of the frame parts of different structural assemblies are at least partially displaced into one another, be so constructed that the ceiling strips of the frame parts, viewed from the bearer wall strips, are constructed to taper in their vertical extension. In this case, selectively the upper and/or lower edges of the ceiling strips may extend at an acute angle with respect to the horizontal. For additional stiffening of the frame parts, for example for structures which are set up on areas where there is a risk of earthquake, it is proposed that at least within some frame parts, between nodal and/or connecting component elements of a ceiling strip and connecting and/or terminal component elements of the or of the next higher or next lower ceiling strips in a diagonal strip, block and/or beam-shaped component elements be disposed which are possibly held together by means of tensioning ropes. In many cases, it is not necessary for these diagonal strips to be constructed according to the development of bearer wall and ceiling strips according to the invention, since these diagonal strips are always only subjected to a compressive loading. Furthermore, it is proposed that frame parts of the same and/or different basic form be braced together to form groups, the groups being braced together to form a structure. Thus, also within a structure which is braced together to form one whole, it is possible to achieve different types of sub-divisions, so that for constant strength, by moving one group of the same basic frame part shape, to produce balconies, staircases or even rooms which are offset with respect to one another, and even larger parts of a structure which are disposed in a staggered relationship to one another. A simple attachment of the roof, ceiling and floor coverings is then possible if the component elements of the ceiling strips have on their upper and/or undersides recesses or projections to accommodate these coverings. According to requirements, so the ceiling strips of a frame part or of different frame parts may be of different lengths from one another.

According to a method according to the invention, for the production of the aforesaid structures or parts of structures, it is suggested that the self-supporting frame parts be individually and horizontally produced, set up and connected to one another by means of tensioning wires. This has the advantage that in conventional manner only the necessary structural blocks and the pull ropes or tensioning wires but not large prefabricated and heavy fabricated parts have to be transported to the building site. After the first and each subsequent frame part has been erected, tensioning wires are pushed through the holes in the terminal, nodal and, if applicable, connecting component elements and after provision of a structure or structural group they are stretched taut with respect to the building elements. It may in some cases be necessary, prior to final tensioning, provisionally to hold the frame components together. The setting up or connecting of the frame parts requires no specialized knowledge and can be undertaken by unskilled labor, since the frame parts are arranged on the tensioning wires in the same way as pearls on a string. So that the frame parts are aligned with one another, it may be favourable to set them up on provisional foundation strips or beams or the like which are however required for erection until the tensioning wires are drawn taut, since after this drawing taut, the frame parts are held so pressed against one another that the friction forces of the frame parts inter se prevent any displacement. The frame parts themselves are in a simple manner so produced that end components, block and/or beam-like components, possibly connecting blocks and nodal component elements are laid on a plane surface of the desired form of the frame part, are provided with pull ropes and while horizontal, are braced with one another. Also here, no special anchoring of the component elements inter se is required, since the pulling ropes press the component elements so firmly against one another that the friction between the component blocks prevents any displacement or dropping thereof. To produce the frame parts, all that is required is a flat surface of the size of the desired frame part or which has portions of flat area corresponding to the size of the desired frame part or bearer wall or ceiling strips. When a relatively great number of such ceiling strips are used, it may be favourable for the ceiling strips to be supplied to the building site braced together as a unit and to be combined there and braced with respect to the structural elements which form the bearer wall strips.

In some cases, it may even be favourable, inside a mould which reproduces the external contours of a ceiling strip, to maintain the pull ropes in their envisaged tensed position, sleeves for producing holes for the tensioning wires and pull ropes possibly being incorporated, after which the mould is filled with concrete and, after the concrete has set, the pull ropes are then relaxed and the ceiling strips connected to one another after the incorporation of bearer wall strips. Even if, according to these instructions, the ceiling strips are produced after the fashion of pre-stressed concrete, this form of embodiment is nevertheless based on the inventive idea that the individual parts of a frame part are so held to one another and the frame parts are so held to one another by tensioning wires or pull ropes that the individual tensioning parts are frictionally connected to one another. In order, for example on a building site where only a minimum of space is available, to be able to set up the frame parts, it is suggested that a ceiling strip be provisionally braced and set up with the component elements of a bearer wall strip which are required as far as the next ceiling strip in succession, one or more ceiling strips with the associated component elements of the bearer wall strips being placed on this partial frame and the pull ropes being incorporated after which the pull ropes are stretched taut. This has the advantage that now apart from the ground area of the structure, virtually no additional space is required, since the partial frames are set up on one another and are connected by pull ropes. This is expediently effected by using a crane so that the partial frame to be positioned on the first or on a subsequent partial frame is held at a minimal interval above the previously laid partial frame after which the pull ropes can be pushed through the corresponding holes, for example in the nodal elements, after which the further partial frame is set in place. For this purpose, it is ideal for partial frames in the form of an "L" or double "L" or a "T" or a double "T" being placed on one another to form a frame part. Where partial frames are placed on one another to achieve the complete frame part, it may be favourable for the ceiling strips of a frame part to be supported with respect to one another during assembly. It is expedient for the ceiling strips already to be braced in their final condition so that all that is required is for the bearer wall strips to be placed loosely on one another. After the component elements have been combined to form a frame part, they can be erected by means of a crane or pull ropes. In order to simplify an alignment of the component elements into the final form of the frame part, it is suggested that the component elements of the bearer wall and ceiling strips be placed in a mould disposed flat or obliquely to correspond to the frame part, braced and set up together with the mould. In this case, production of the frame parts is particularly simple, since the corresponding component elements need only be inserted into the mould. For example, if it is assumed that the block and/or beam-shaped component elements have the cross-sectional form of a double "T", then for example the first nodal, connecting and terminal component elements can be inserted, the pull ropes introduced and then the block or beam-shaped components can be inserted after which, in the case of two pull ropes per strip, the next pull rope is introduced. Then, it is necessary only to stretch the pull ropes taut and attach them to the terminal blocks. According to the development of the structure, it may in some cases not be necessary for each frame part to have all complete bearer wall and ceiling strips. Therefore it is suggested that the frame parts for producing a skeletal or frame-like structure be disposed at a distance from one another, parallel and in alignment with one another, that intermediate parts be inserted and the frame parts be connected to one another by means of the tensioning wires. The construction according to the invention makes it possible for example to incorporate ceiling strips without support on bearer wall strips, since after stretching of the horizontal tensioning wires taut, these ceiling strips are secured frictionally against the neighbouring ceiling strips so that a support is necessary only prior to tensioning of the wires. In a particularly simple manner, such a support is provided by incorporating into the frame parts adjacent to the intermediate parts and directly beneath the intermediate parts console elements on which the intermediate parts are laid after erection of the frame parts.

In the case of a form for producing frame parts, it is ideal for setting up the completed frame part for the form or mould to be mounted on a vehicle and to be disposed to pivot about an axis transversely or longitudinally thereof. In consequence, according to the size of the frame part, this latter can be built up and braced anywhere, then conveyed to the building site where it can be erected. The setting up can easily be effected by the mould being tilted via a hydraulic cylinder about pivoting axes transversely or longitudinally with respect to the vehicle and into the vertical. Since, once the frame part has been braced up, it is self-supporting, the mould may have a centre part which substantially accommodates the bearer wall strips and side parts associated with the ceiling strips, the side parts being adapted to be lowered and/or the centre part being adapted to be raised. In consequence, relatively large parts of the mould can be left at the clamping-up station so that for example only the middle part is mounted on the vehicle. By reason of the construction of the building according to the invention, it is possible for the frame parts to be placed on levelled earth in which there are no foundations.

Advantages and features of the present invention will be summarized hereinafter:

The frame parts combine in themselves all elements which have a bearing function, in a building or a structure, such as the under-surface of the structure or the foundation floor, the bearer walls and columns as well as the beams and planks of the floors, ceilings and roofs.

The frame parts comprise as an integrating part a universally applicable foundation floor which is intended for use on the most widely diverse types of soil.

The frame parts can be produced in such a geometric form that they allow the architect a maximum of designing freedom in the sub-division of the structure.

With simple basic frame shapes, it is possible, using the unit construction principle and by combination, to provide the most widely diverse types of structure such as bungalows, factory workshops, villas, schools as well as complex buildings such as hospitals and multi-story dwelling houses.

The frame parts can be prepared or pre-fabricated on the building site or at some central point using simple pre-fabricated and standardized component elements.

With a very small number (three or four) of types of component element, it is possible to produce all manner of frame parts.

Always the same types of elements can be used in the same disposition to produce all conceivable frame parts of various geometric forms.

By reducing or increasing the number of component elements in the bearer wall and ceiling strips, it is possible to vary the height of the story and the extent of the ceilings.

The width of the frame parts in a horizontal extension can easily be varied by using component elements of the same shape in double, triple, etc., width.

As a material for the component elements of the frame parts, it is possible to use whatever, while being of a favourable price, has the best properties for the use as a bearing component, which means at present concrete, pre-stressed or given some secondary stressing.

The frame parts can be produced by unskilled labor working at a low rate of wage.

The frame parts can be produced in a flat or inclined position on or close to the ground.

Structures and various types of buildings can be produced by simple erection of the frame parts which are adjacently arranged (like slices of bread, followed by bracing by means of the tensioning wires.

Multi-story structures can be rapidly and easily set up by the positioning of frame parts on already erected assemblies of frame parts, a simple coupling of the pulling ropes allowing a bracing of the lower and upper frame parts.

The structures according to the invention are resistant to earthquakes and can furthermore be so reinforced by the insertion of diagonal strips which can easily be produced as in the case of bearer wall and ceiling strips, so that they will resist even severe earthquakes.

Even for structures in large numbers, only minimal investments of simple materials are required, a building time being achieved which is far shorter than is possible with other types of building.

According to the invention, it is just as easy to produce structures having flat roofs as other having sloping roofs.

For further explanation of the invention, reference is made to the drawings which illustrate in simplified form a plurality of examples of embodiment of the invention. In the drawings:

FIGS. 1*a* to 1*c* are perspective views of parts of frame parts with nodal, connecting and terminal structural elements, as well as block and beam-shaped components of various shapes;

FIG. 2 is a transverse view of block and beam-shaped component elements which are constructed as profile elements;

FIGS. 3*a* & 3*b* are views showing the principle of basic frame shapes which are combined to form structural assemblies or structures, the basic frame shapes having according to FIG. 3*b* free bearer wall strips;

FIGS. 4*a* to 4*c* are perspective views of frame parts, the width of the bearer wall and ceiling strips being shown;

FIGS. 5*a* to 5*e* show structural assemblies which are composed of frame parts of different basic shapes;

FIGS. 6*a* to 6*c* show structural assemblies with frame parts of different basic shapes, some frame parts being disposed offset with respect to the other frame parts;

FIGS. 7*a* to 7*f* show particular constructions of the bearer wall and ceiling strips for accommodating or for forming roofs;

FIGS. 8*a* to 8*f* show frame parts of different basic shapes, in which the ceiling strips are variously constructed, tapering out from the bearer wall strip;

FIGS. 9*a* & 9*b* show a frame part and a structural assembly of a plurality of frame parts in which various types of diagonal strips are incorporated;

FIGS. 10*a* and 10*b* show structural assemblies built up from a plurality of frame parts and in which various types of cladding are provided at the projecting ends of the ceiling strips;

FIGS. 11*a* to 11*b* show structures which are provided by the adjacent combination of structural assemblies with frame parts of identical basic shape;

FIGS. 12 and 12*a* show a frame part and ceiling part production shop with moulds as well as rails and trolley cranes by which the structural units are moved;

FIGS. 13 and 13*b* show a relatively large structure or relatively small structural assemblies on an enlarged scale, in which the erection of a frame part and the disposition of a partial frame on already erected frame parts is illustrated;

Figure 1A:
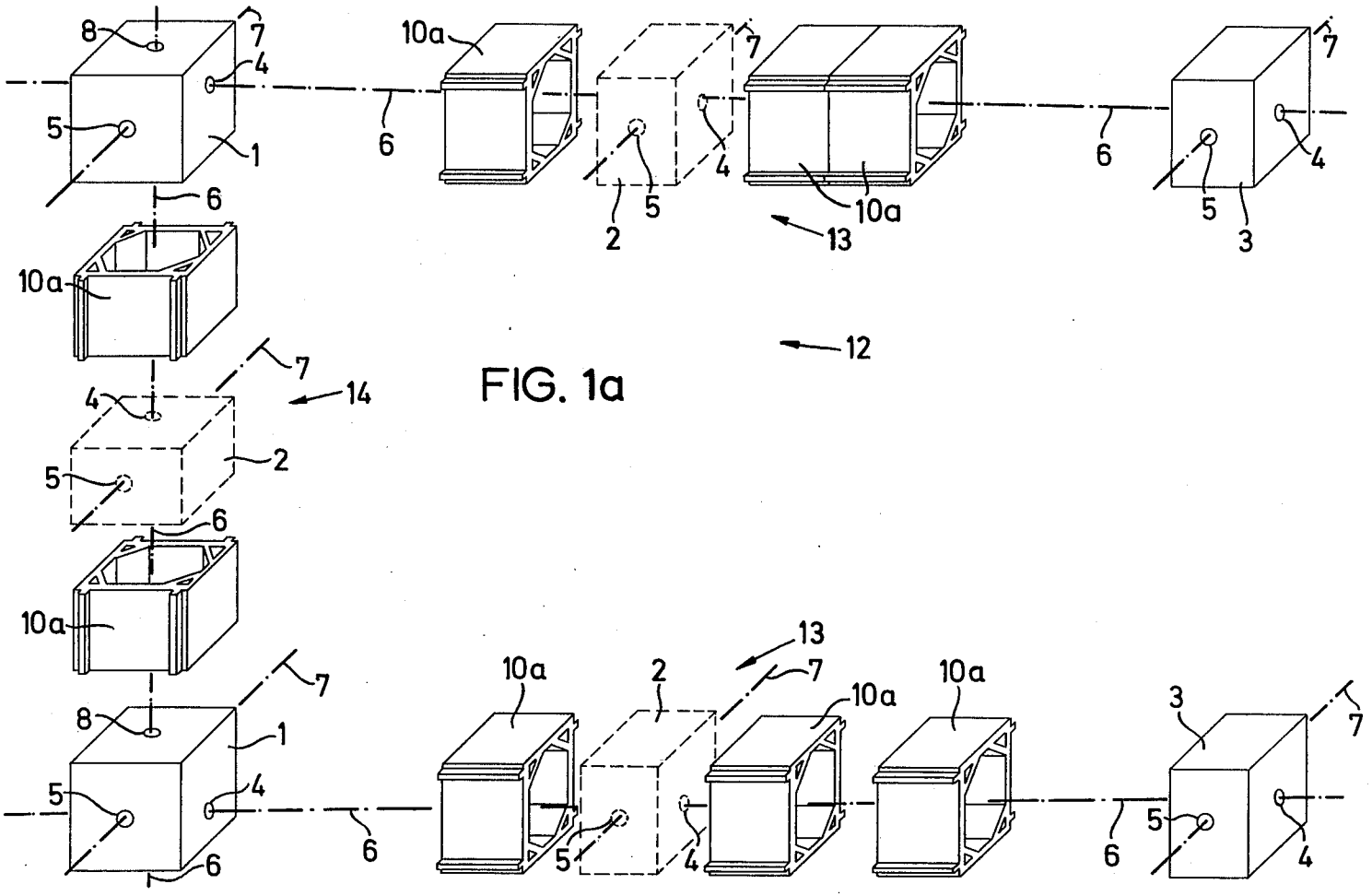
Figure 1B:
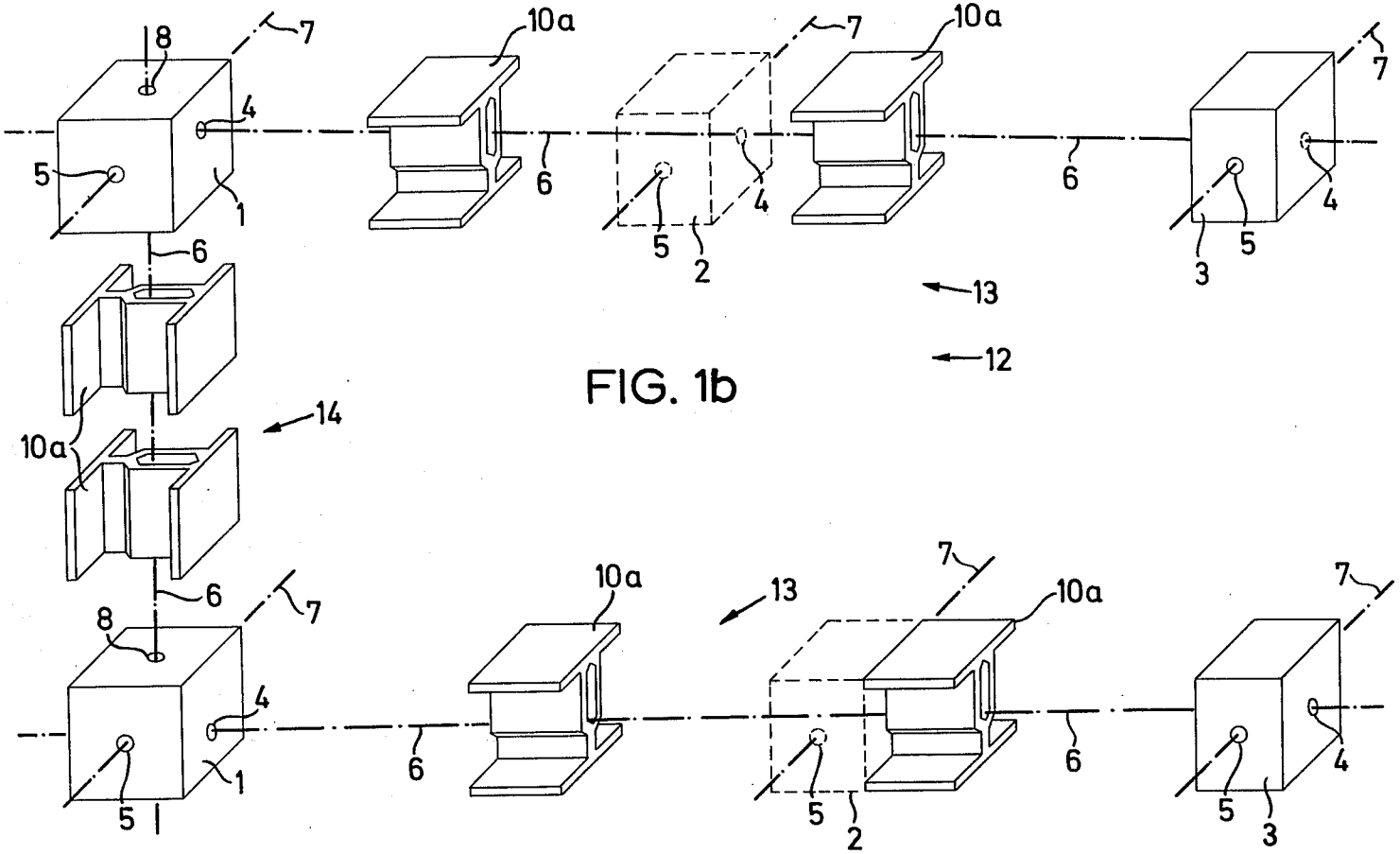
Figure 1C:
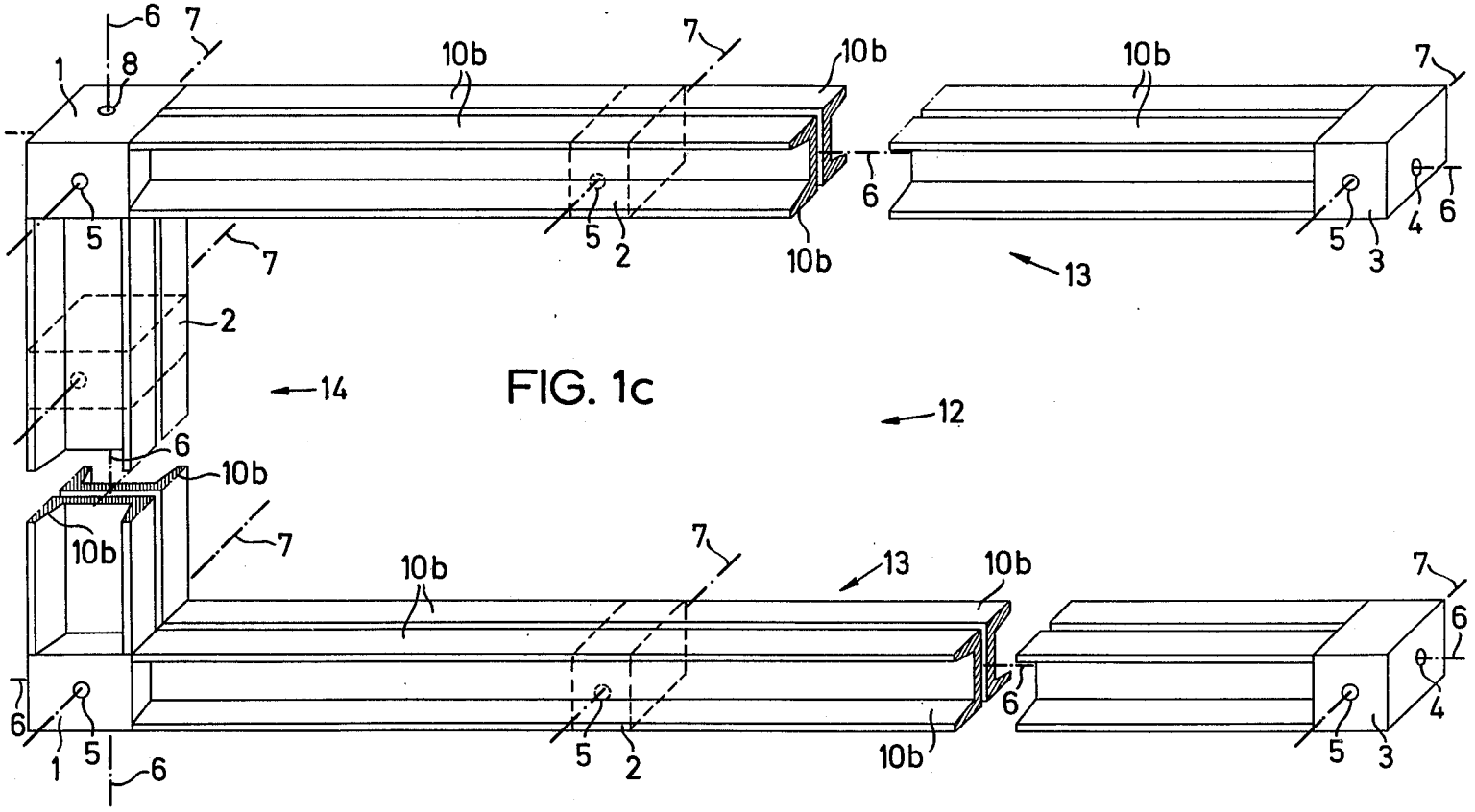

FIGS. 1*a* – 1*c* show nodal blocks 1, connecting blocks 2 and terminal blocks 3. These blocks are constructed as solid blocks and have extending at right-angles in one plane holes 4 and 5, the holes 4 serving to accommodate a pull rope 6 while the holes 5 serve to accommodate tensioning wires 7 which differ for each nodal, connecting and terminal block. In addition to the holes 4 and 5, the nodal blocks 1 have at right-angles to this hole plane holes 8 which serve to receive a further pull rope 6. Between the block, connecting and terminal elements there are in FIGS. 1*a* and 1*b* block-shaped component elements 10*a* which are in FIG. 1*a* constructed as hollow profile blocks while they are constructed in FIG. 1*b* as double "T"-shaped profile blocks. In FIG. 1*c*, there are between the nodal, connecting and terminal blocks beam-shaped component elements 10*b* which are constructed in a "U"-shape, in each case two structural elements being disposed one beside the other. As shown in FIGS. 1*a* to 1*c*, the nodal, connecting and terminal blocks 1, 2, 3 as well as the block and/or beam-shaped component elements 10 are combined into one frame part 12 which, according to requirements, may have various shapes and sizes. After the structural elements have been disposed in their desired position, the pull ropes 6 are attached at their ends, for example by means of hydraulic traction apparatus, brought to a desired initial tension with respect to the terminal blocks and are secured by means of tensioning elements so that they press the structural elements securely against one another. In this respect, the traction of the tensioning ropes must be so great that even upon a transverse loading of the component elements, there is no slippage between the individual blocks and so that there is adequate compressive tension between the blocks. In the erected state, in other words when the pull rope 6 disposed between the nodal component blocks 1 extends vertically, the frame part 12 forms a strip of a structure, component elements which are disposed between the nodal element 1 and the terminal block 3 being disposed along the pull rope 6, forming a ceiling strip 13 while the component elements disposed between the nodal blocks 1 forming a bearer wall strip 14.

Figure 2:
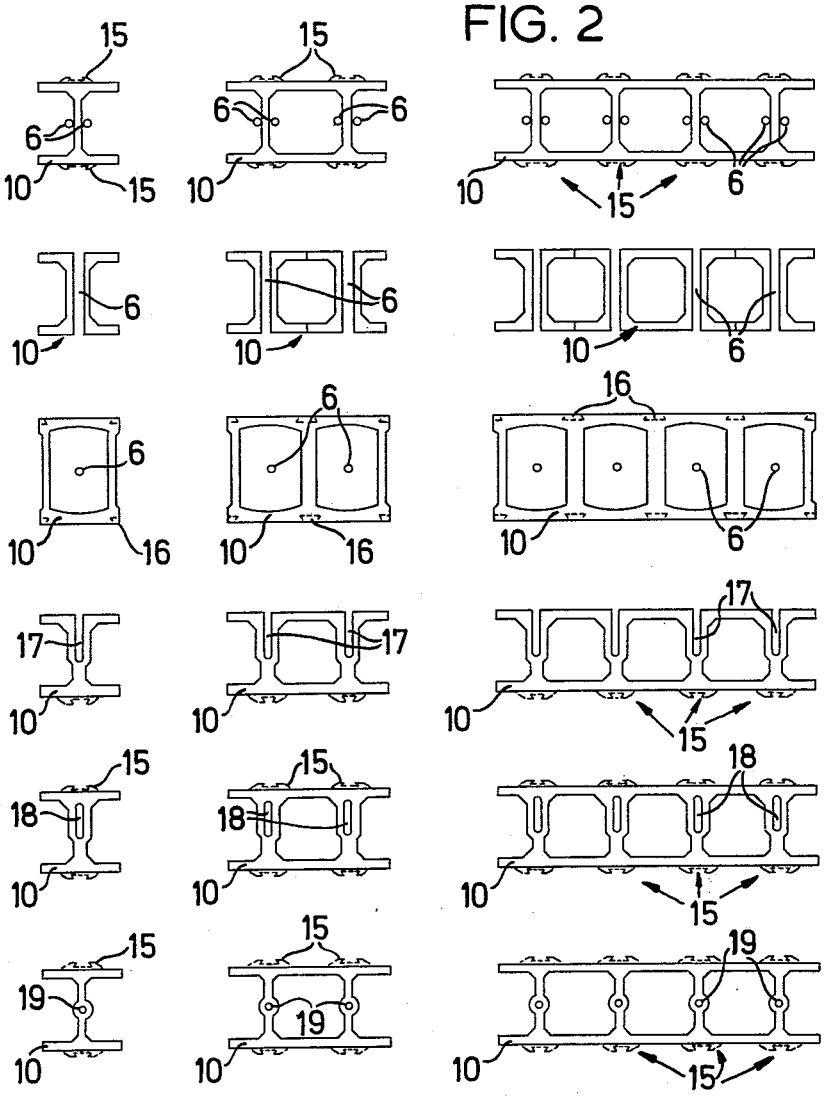

The profile structural elements shown in FIG. 2 may be constructed both as block-shaped component elements 10*a* and also as beam-shaped elements 10*b*, since these elements differ one from another solely by reason of their length and the component elements in FIG. 2 are shown only in cross-section. Consequently, the component elements in FIG. 2 are designated 10. The component elements of the topmost row are based on the basic shape of a double "T" can be produced as component elements with a plurality of double "T" profiles. The broader are the building elements, the broader is the frame part 12, so that the provision of the structure proceeds more rapidly. The structural elements of the first and last rows have on their outer surfaces projections 15 on which roof, ceiling and floor coverings can be attached. In the case of the shape of the building element of the first row, the pull ropes 6 are disposed alongside the middle web of the structural elements. In the case of structural elements which consist of a plurality of double "T" profiles, then naturally, according to the loading, a smaller number of pull ropes may be used than shown in FIG. 2. The basic form of the structural elements according to line 2 in FIG. 2 corresponds to a horizontal "U", at least two blocks being disposed one beside the other so that the pull rope 6 is disposed between the two webs. The individual blocks are joined loosely to one another so that this basic form is offered particularly for beam-shaped component elements 10*b*, since the weight of the individual elements can be kept small by sub-division. The structural elements according to row 3 in FIG. 2 have a rectangular frame-shaped cross-section, the pull ropes 6 being disposed in the interior of the cavities. In contrast to the other structural elements, these have recesses 16 to accommodate roof, ceiling or floor coverings. These recesses are particularly favourable, even when these blocks are used in bearer wall strips, since in such cases no projections 15 are required. Attention is however drawn to the fact that also the other forms of structural element may have recesses instead of projections. The component elements of line 4 in FIG. 2 have, in constrast to the structural elements according to line 1, a groove 17 starting from the outer surface of the structural element and in which the pull ropes 6 are preferably disposed. Consequently, after provision of the frame parts, the pull ropes can easily be embedded in corrosion-protected fashion by the grouting-in of mortar or cement. The structural elements of the fifth row have, to accommodate the pull ropes 6, recesses 18, while the component elements of the last row in FIG. 2 have bore-like holes 19 approximately in the middle of the web.

Figure 3A:
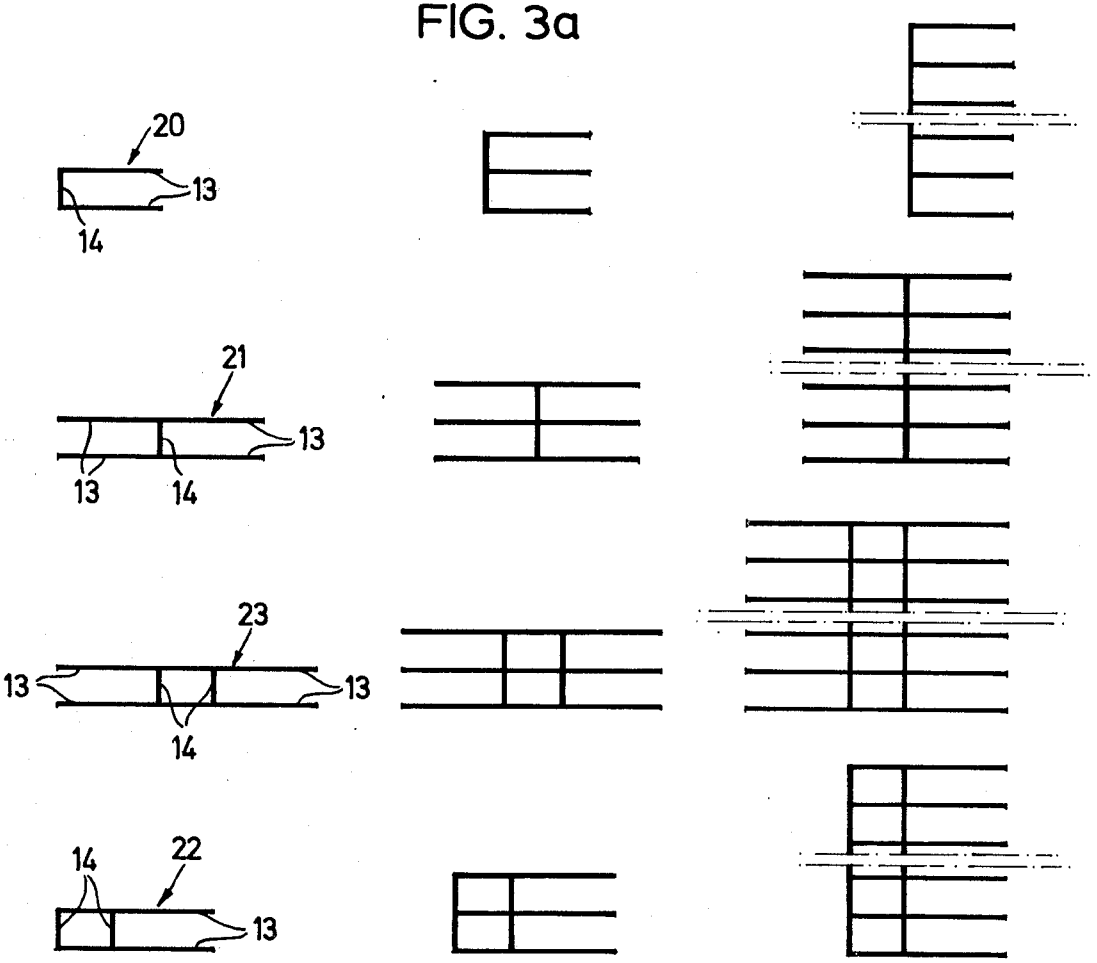
Figure 3B:
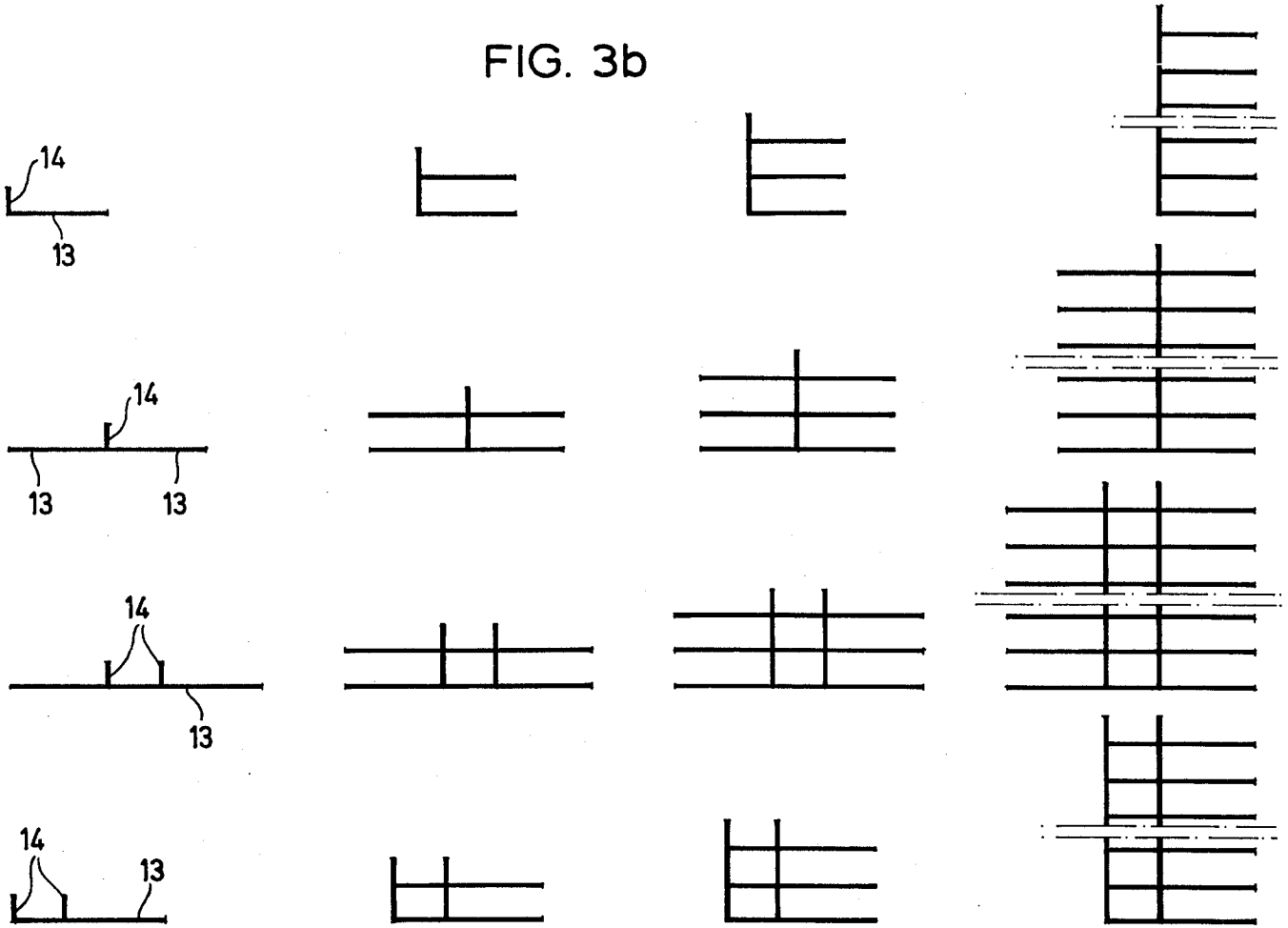

FIGS. 3*a* and 3*b* show in sketched form preferred basic shapes of frame parts. In this case, FIG. 3*a* shows a basic frame mould 20 corresponding to a horizontal "U". Also shown is a basic frame form 21 which has the shape of a horizontal "H". 22 and 23 represent the corresponding modifications of the basic frame form of the horizontal "U" and "H", which have two mutually spaced bearer wall strips 14. For the rest, FIG. 3*a* shows frame parts which are produced by adding together the basic frame shapes. Attention is drawn to the fact that the ceiling strips, corresponding to the desired shape, may be of different lengths both on a frame part and also between the individual frame parts. The basic frame shapes of FIG. 3*b* differ from those of FIG. 3*a* in that in each case an outer ceiling strip is omitted so that the basic shapes of a horizontal "L" or a reversed "T" result. By reason of their free bearer wall strips, these basic shapes are particularly ideal for the attachment of a roof assembly and they can also be used as a partial frame for the erection of a larger frame part, since the successive partial frame can be placed on the free bearer wall strip 14.

Figure 4A:
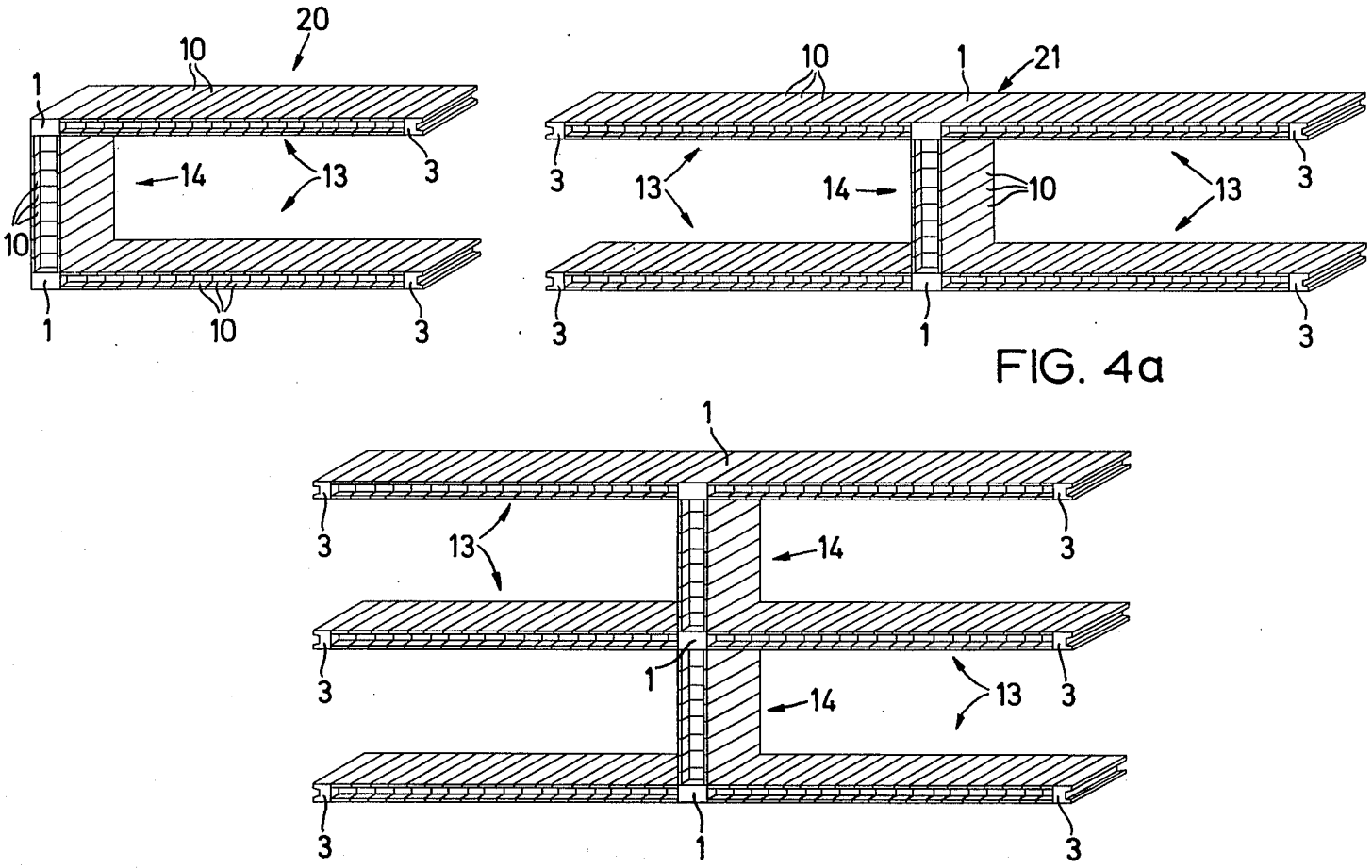
Figure 4C:
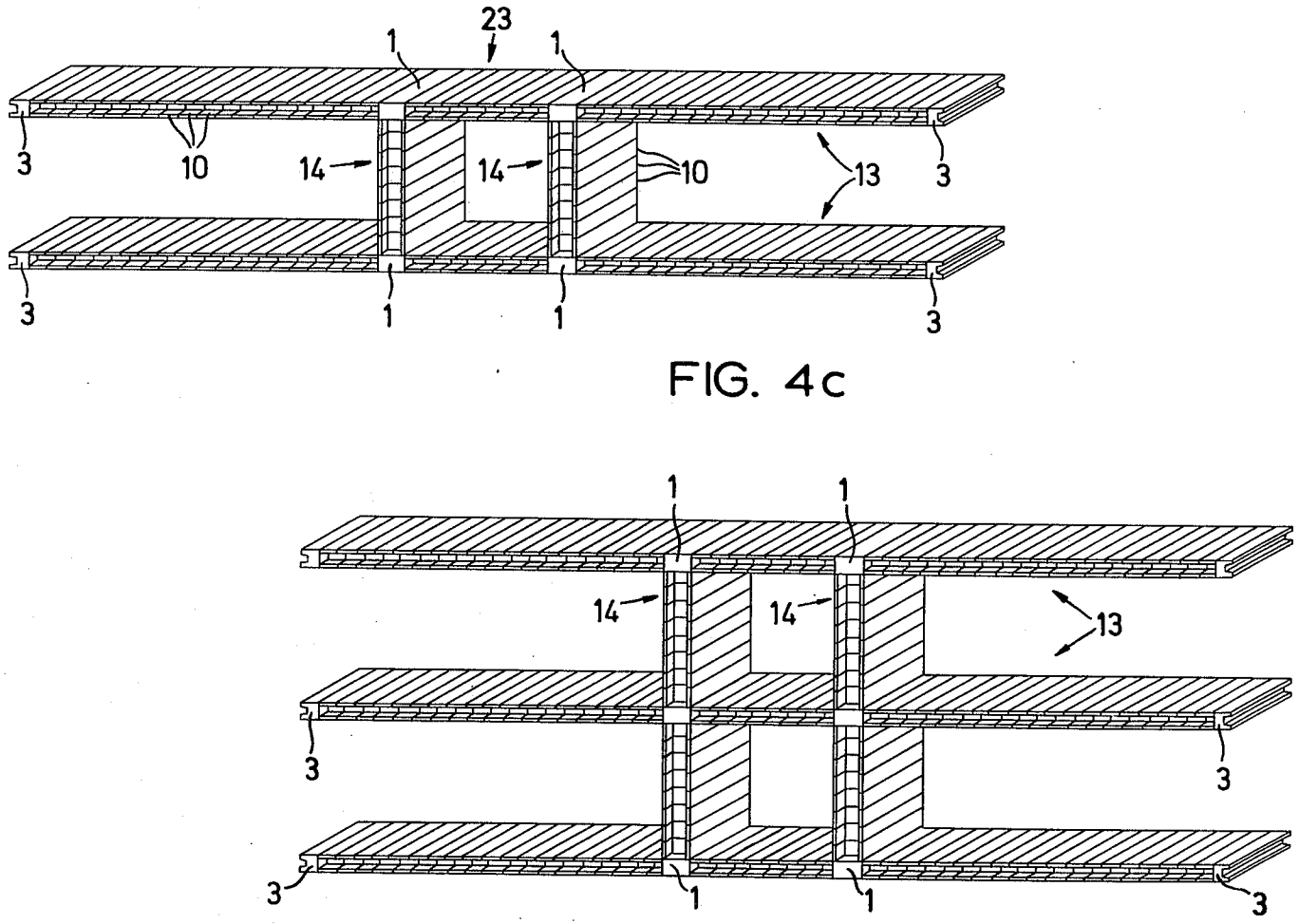

FIGS. 4*a* to 4*c* show on an enlarged scale perspective views of the basic frame shapes of FIG. 3*a*, the same reference numerals being employed. Particularly evident is the horizontal extension of the frame parts and of the individual structural elements.

Figure 5A:
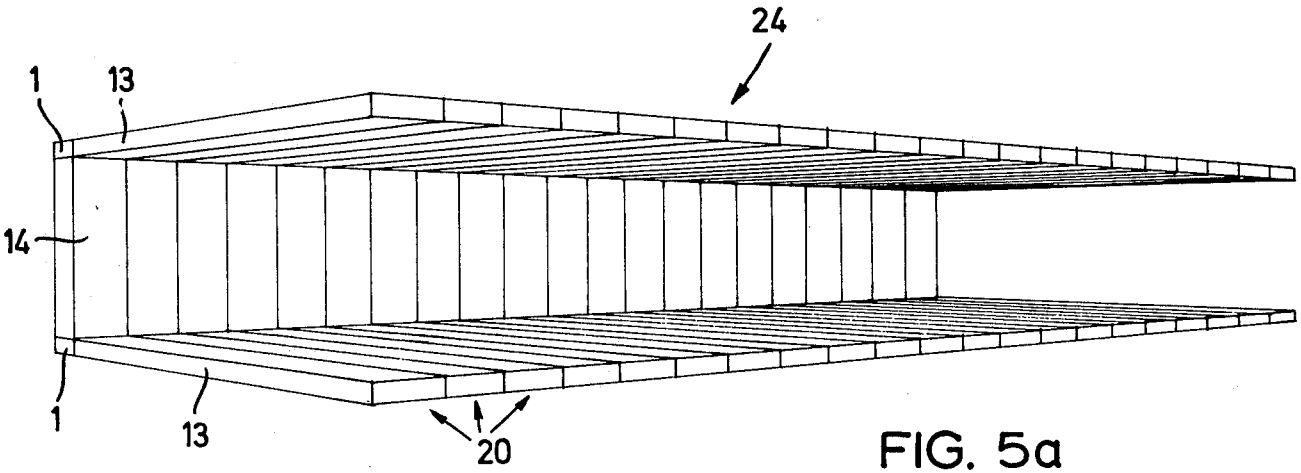
Figure 5B:
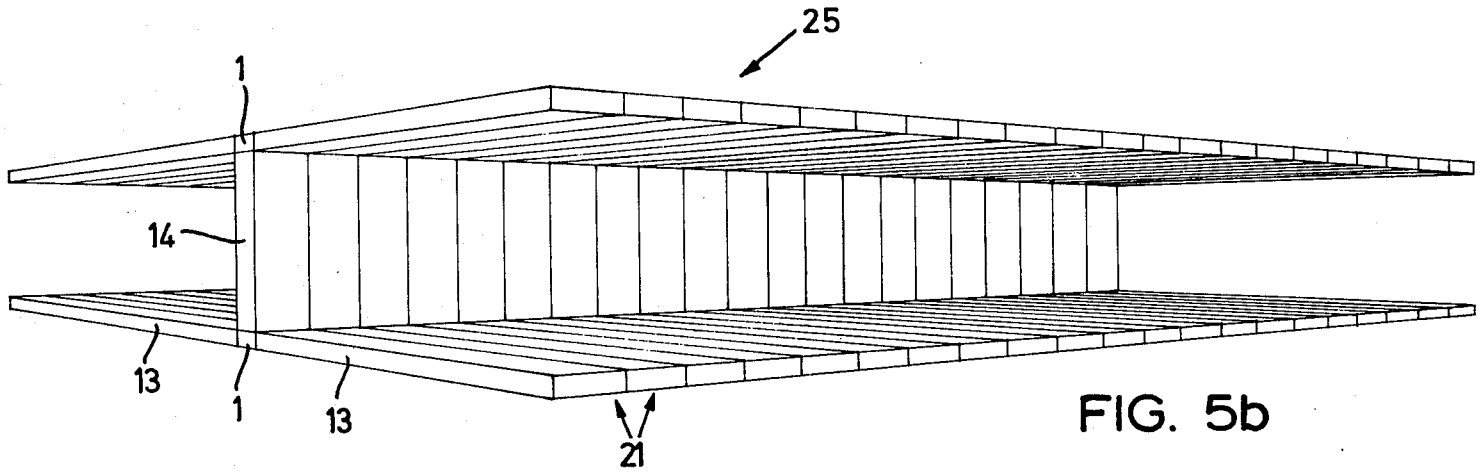
Figure 5C:
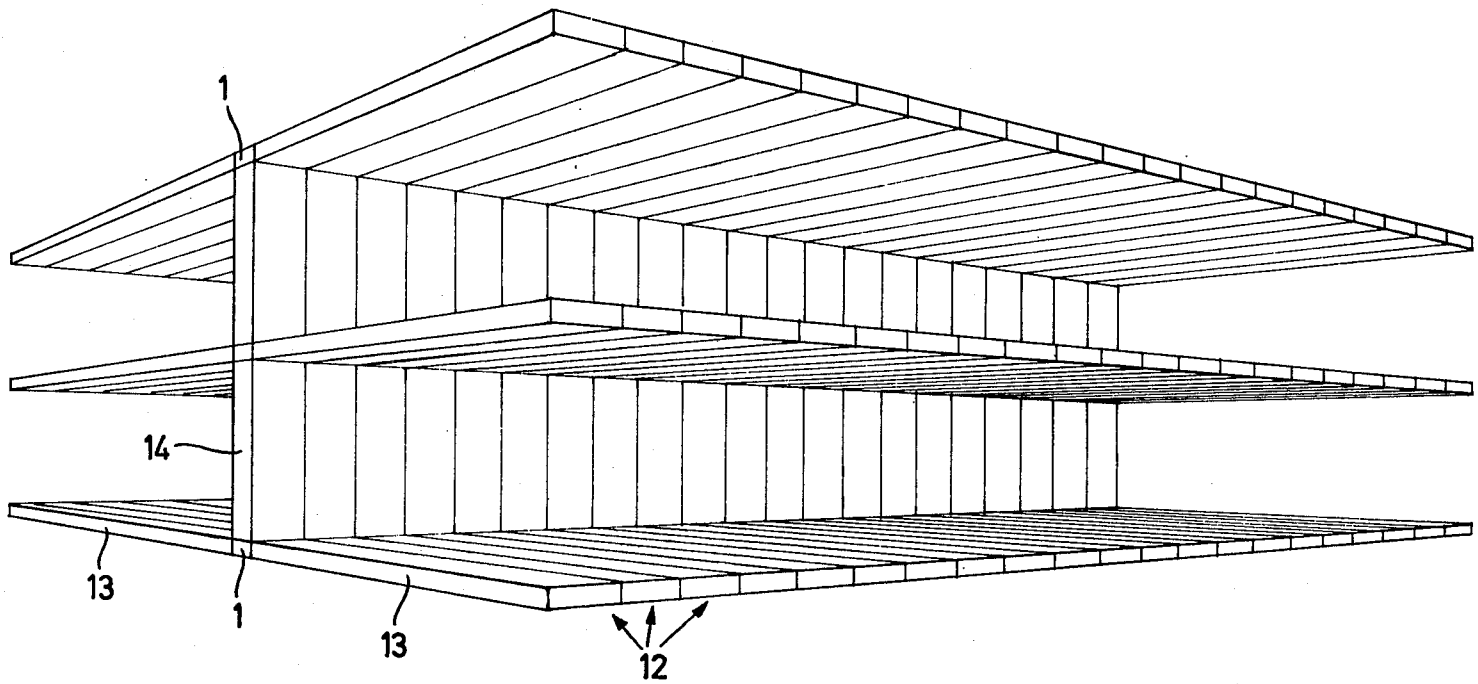
Figure 5D:
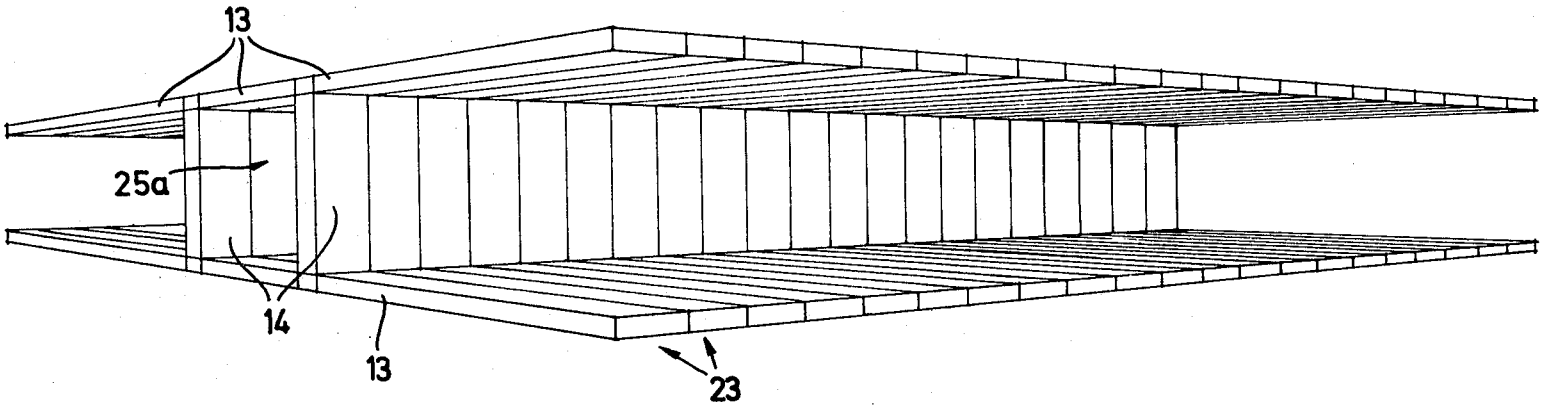
Figure 5E:
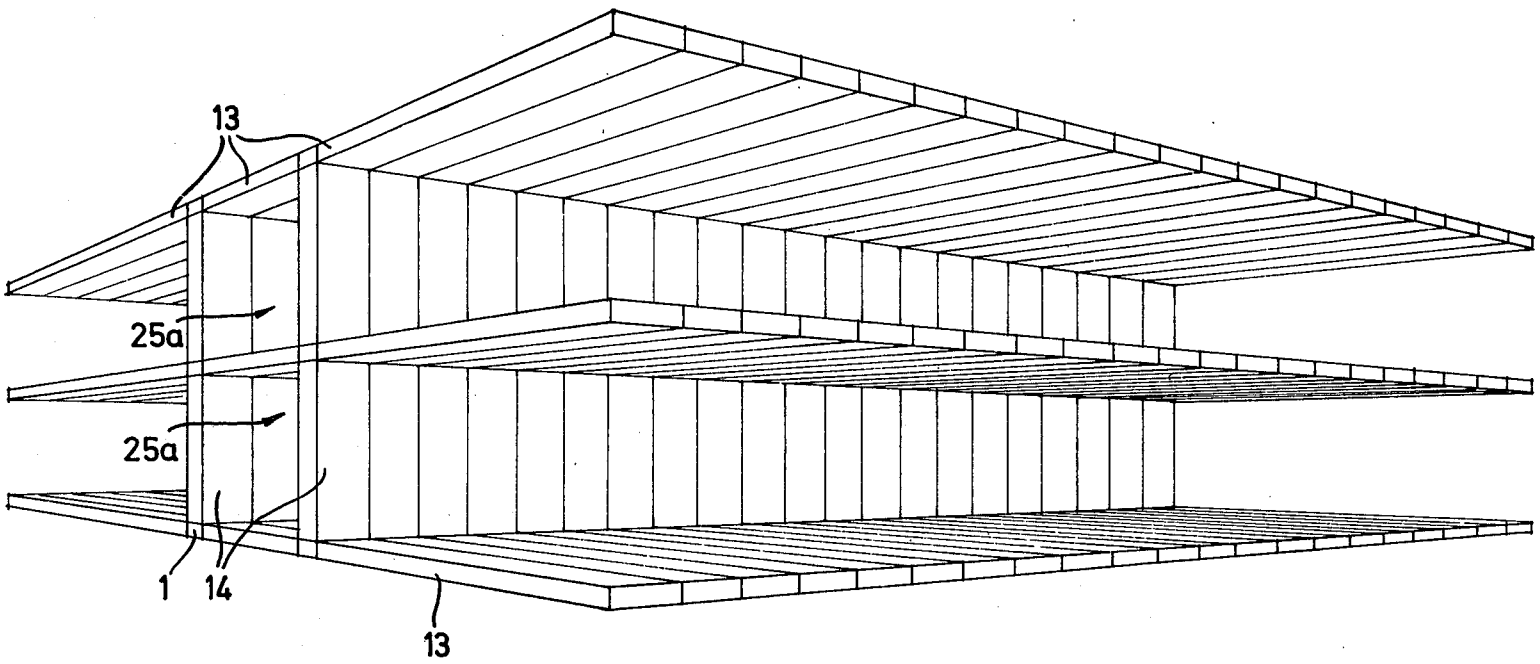

FIG. 5*a* shows at 24 a structural assembly of a structure which consists of a plurality of basic frame shapes 20. FIG. 5*b* shows a structural assembly 25 of a structure which is composed of basic frame shapes 21. The structural assembly according to FIG. 5*c* consists of a modified basic frame shape, the latter having three ceiling strips to form two floors. The structural assembly according to FIG. 5*d* consists of basic frame shapes 23 whereas FIG. 5*e* consists of frame parts which are derived from the basic shape 23. As can be seen from FIGS. 5*d* and 5*e*, the bearer wall strips 14 which are disposed at intervals from one another form as a whole corridors 25*a* which can be used as an entrance to the structure or as a hallway in the structure. Furthermore, staircases for example may be incorporated between these bearer wall strips 14.

Figure 6A:
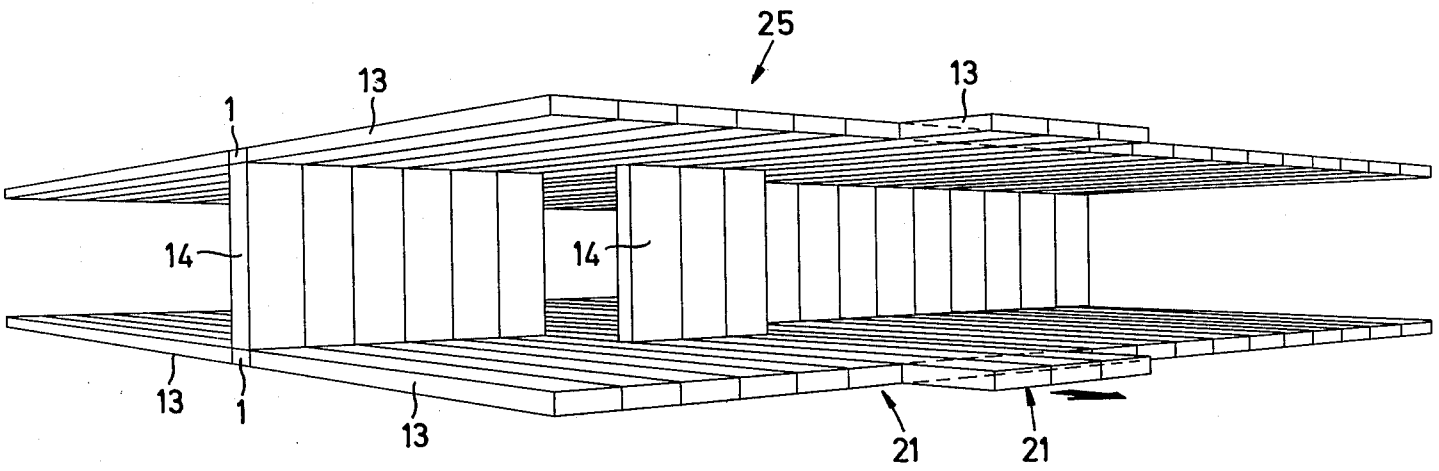
Figure 6B:
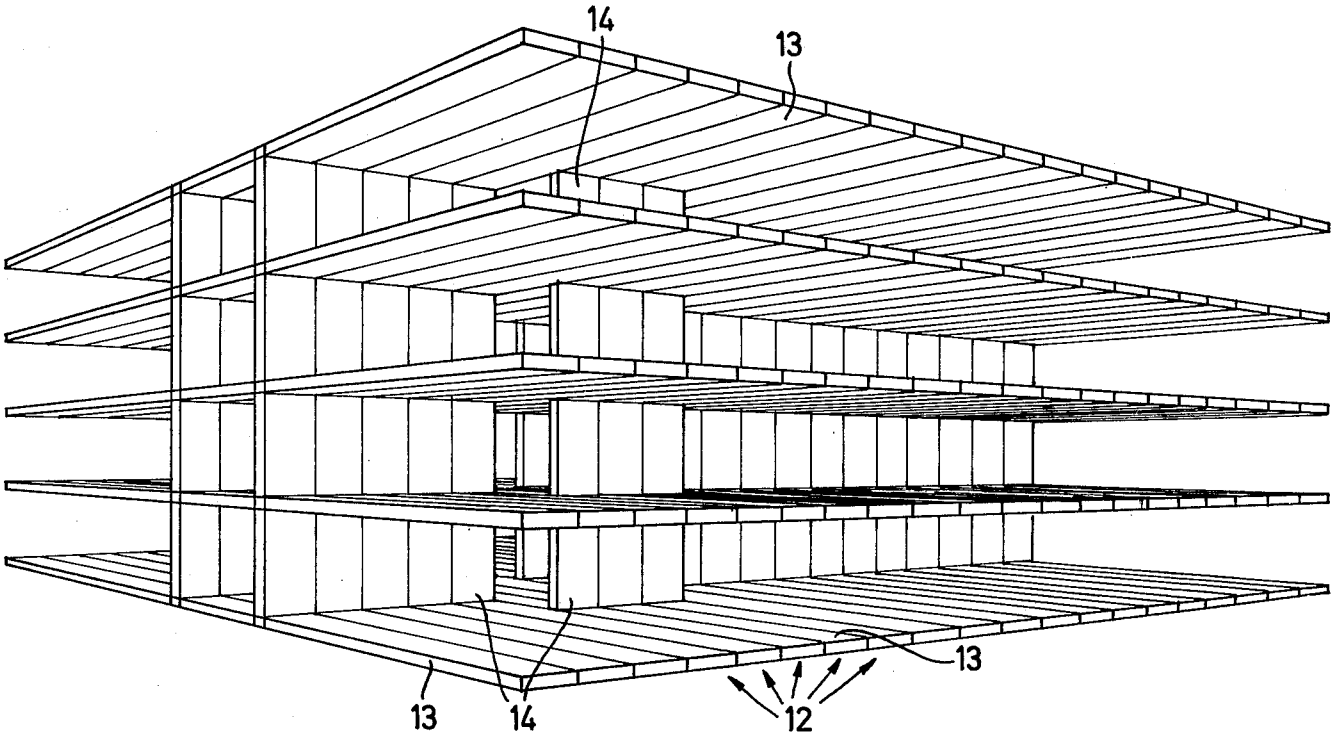
Figure 6C:
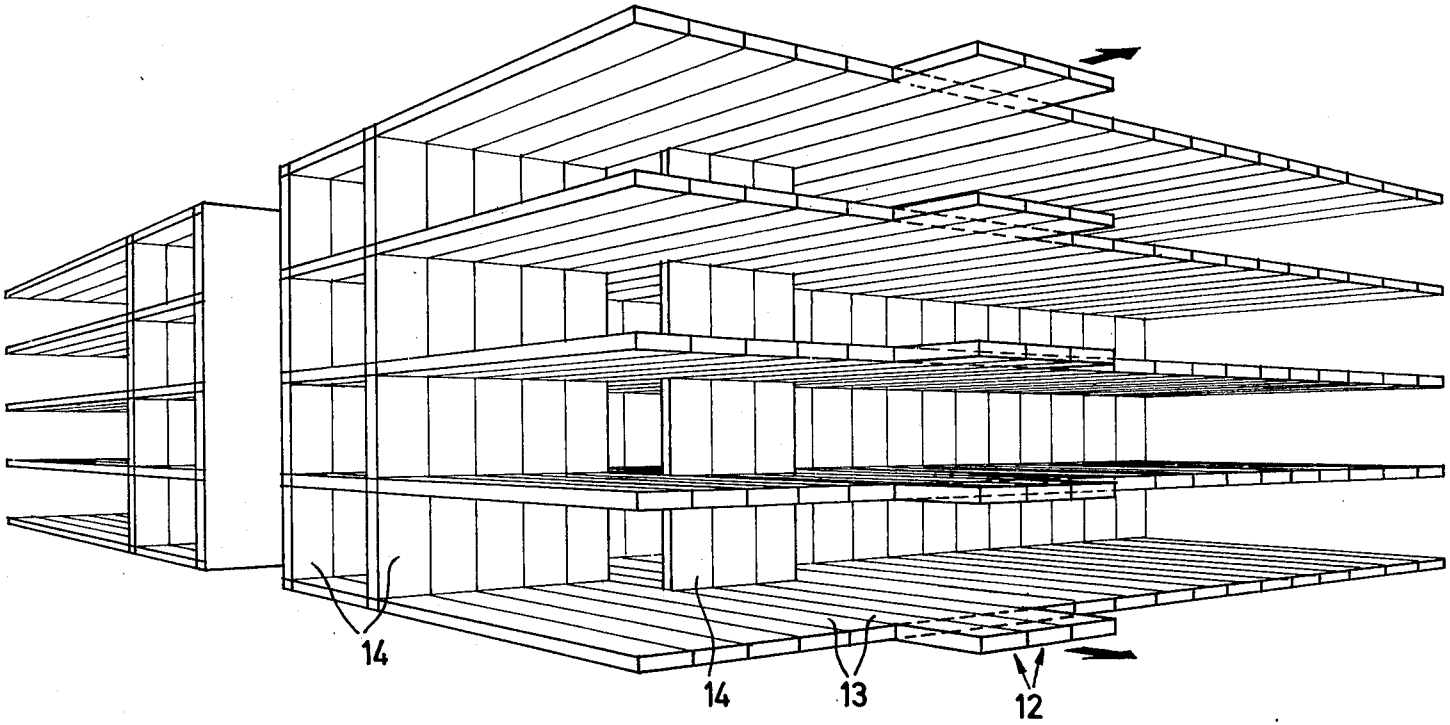

FIGS. 6*a* to 6*c* show various types of structural assemblies of a structure, at least parts of frame parts being displaced with respect to the others. FIG. 6*a* shows a structural assembly 25 in which three basic frame shapes 21 are offset with respect to the other basic frame shapes. Thus, also the bearer wall strips 14 are displaced with respect to one another so that free passages are created. FIG. 6*b* shows a structural assembly of a structure having frame parts modified with respect to the basic frame shapes 23, and in which the ceiling strips 13 of three frame parts 12 are shortened on one side so that with uniform alignment of the terminal blocks the bearer wall strips 14 of these frame parts are disposed in a staggered relationship with respect to the others. FIG. 6*c* shows two structures disposed one beside the other, the structures consisting of frame parts 12 which are formed by modification of the basic frame shape 22. In this respect, in turn, three frame parts 12 are displaced as one unit so that the projecting ceiling strips 13 are created which can be used for example as balconies and whereby the bearer wall strips 14 of these three frame parts are staggered with respect to the others to produce free passages.

Figure 7A:
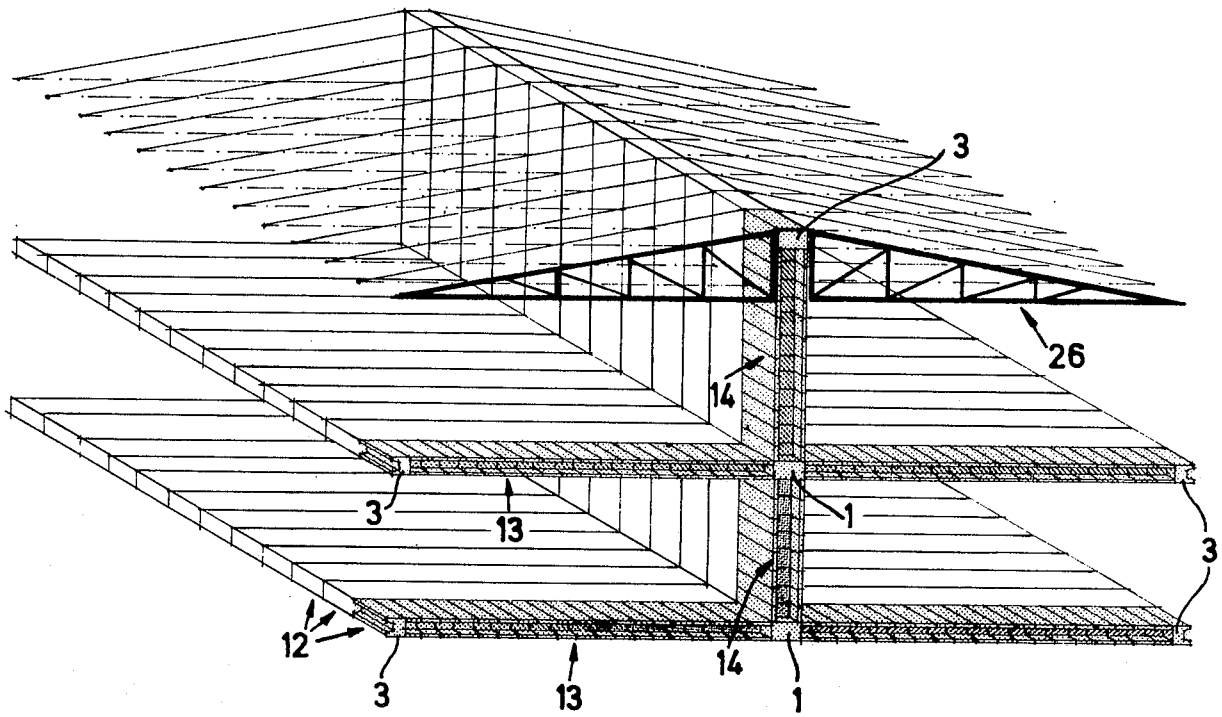
Figure 7B:
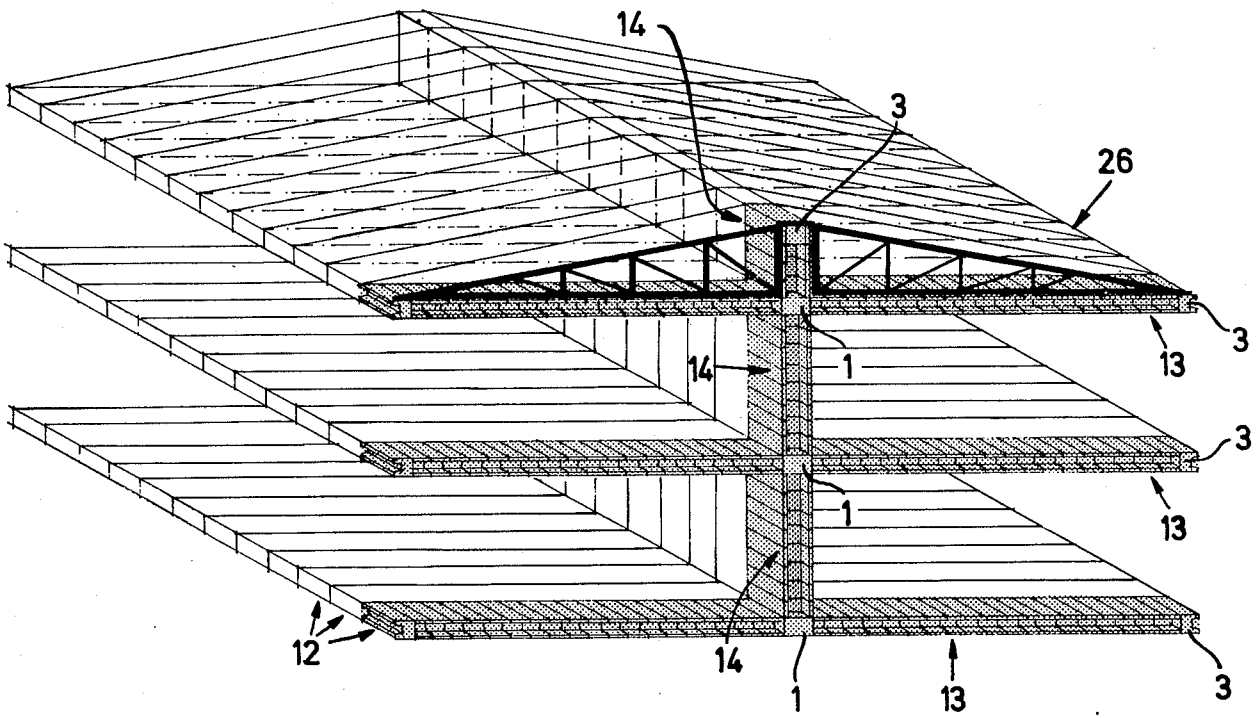
Figure 7C:
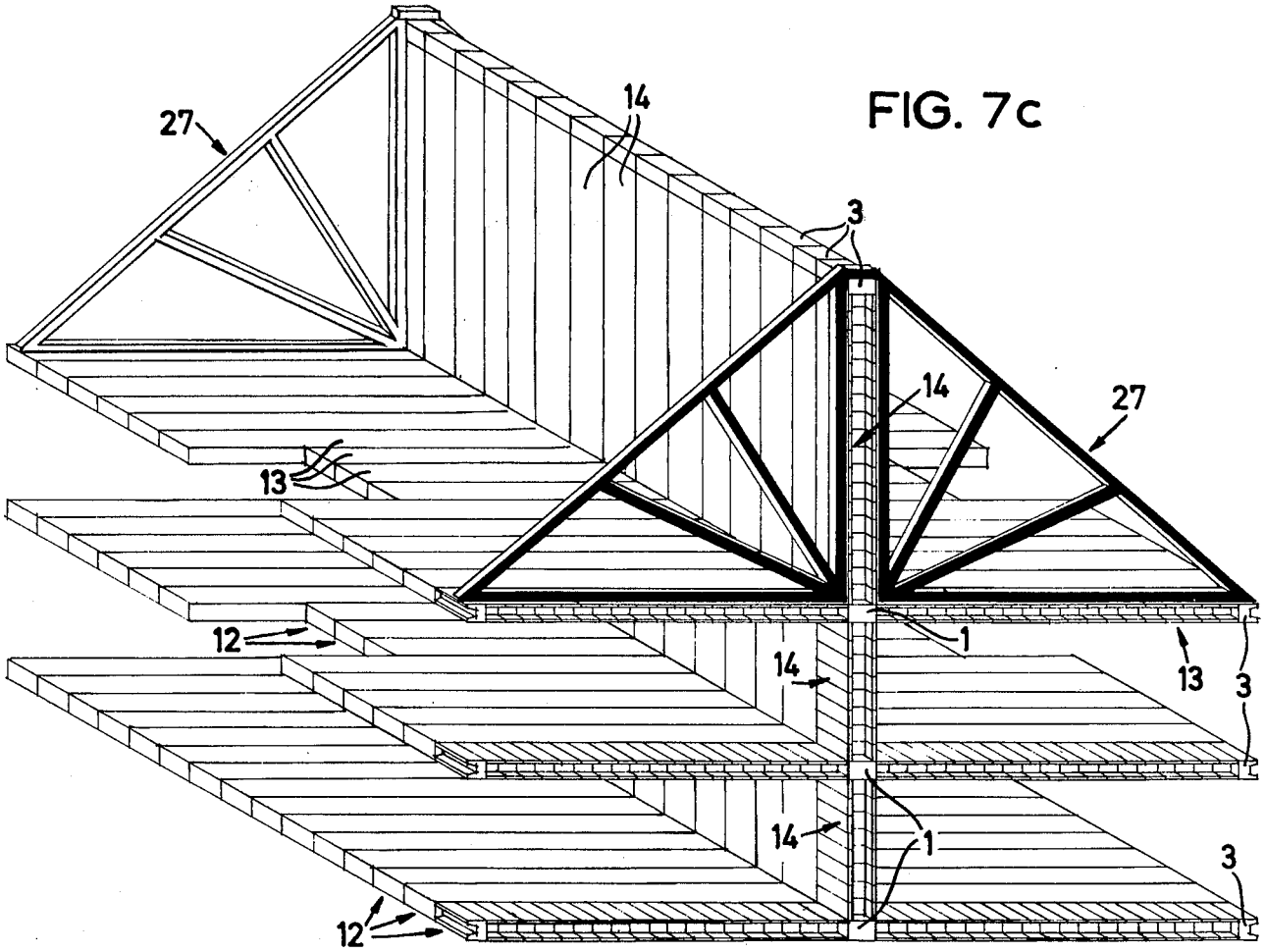
Figure 7D:
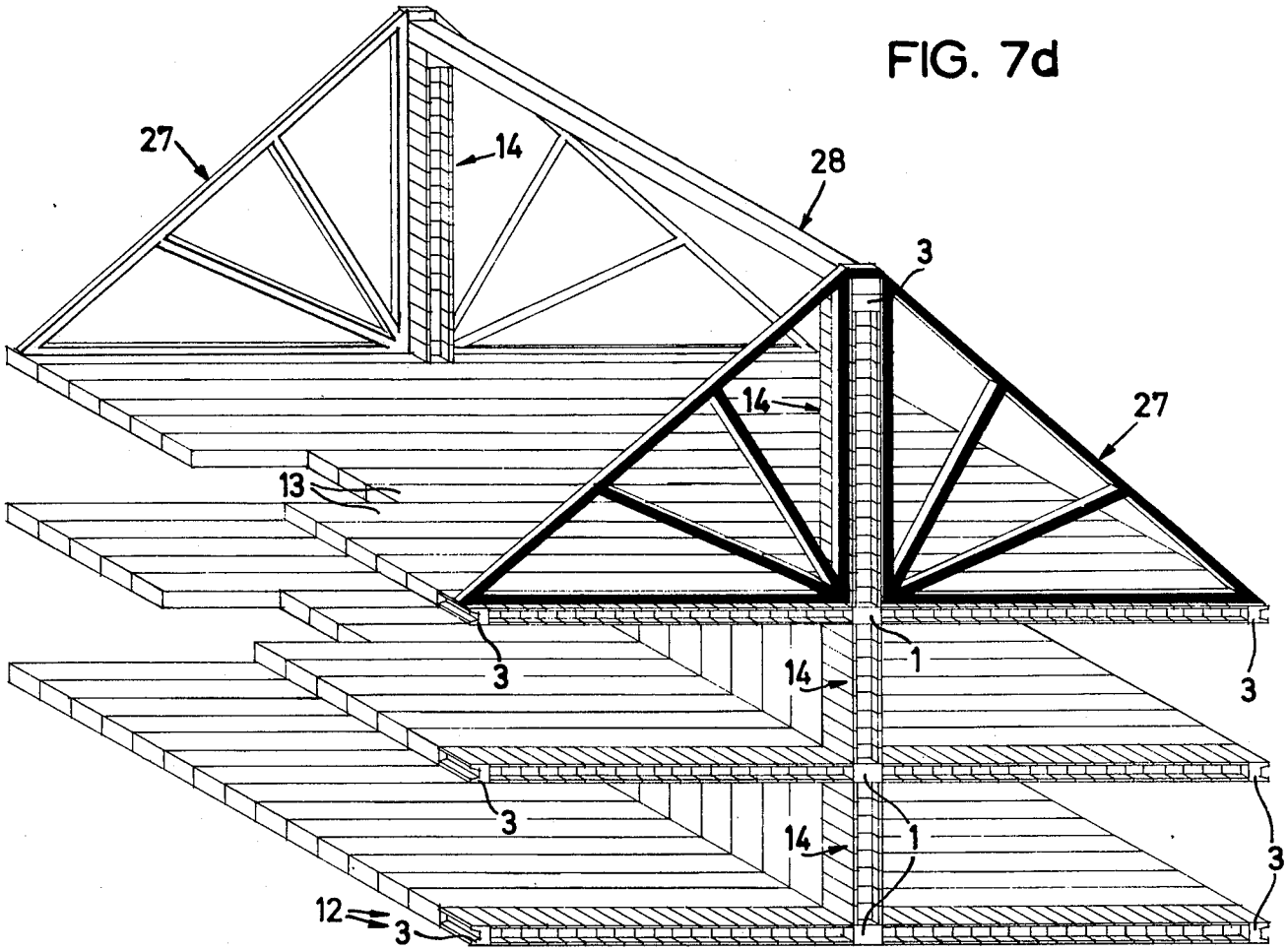
Figure 7E:
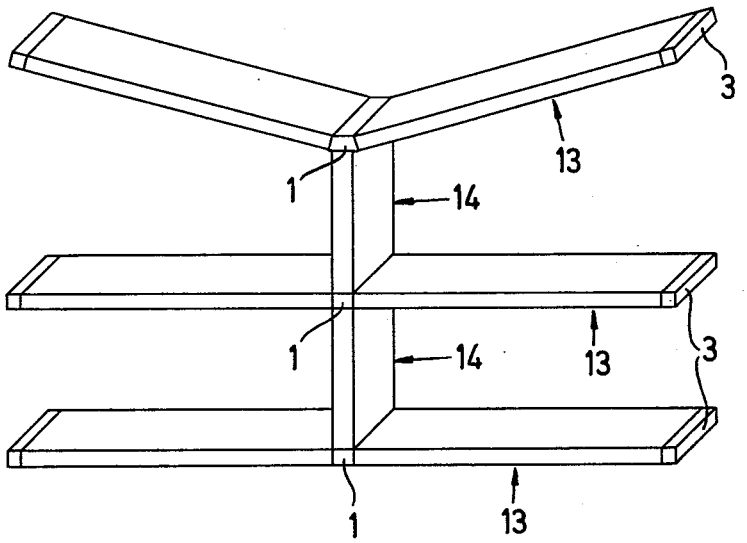
Figure 7F:
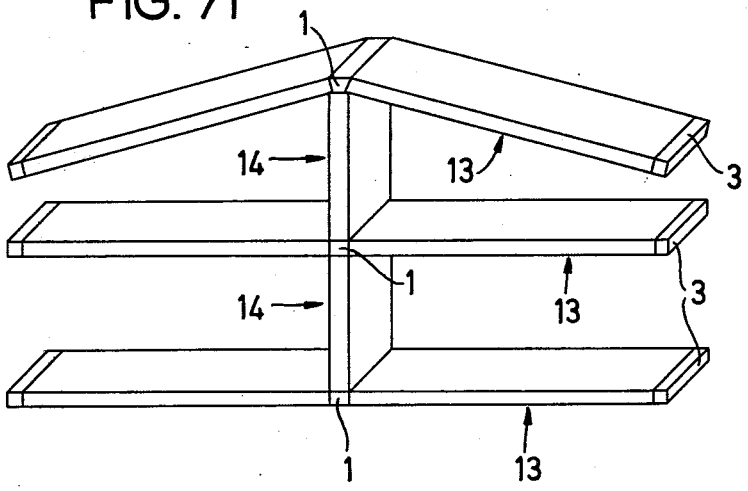

FIG. 7*a* shows a roof assembly 26 which is mounted on the bearer wall strips 14 of the frame parts 12. For this purpose, the bearer wall strips 14 are extended above the upper ceiling strip 12 sufficiently for the bottom edge of the roof assembly 26 to produce the height of a story. Since also the upper free-standing bearer wall strips 14 are braced with the frame part 12, a rigid stable roof structure results. In contrast to FIG. 7*a*, FIG. 7*b* shows the roof assembly 26 resting on the topmost ceiling strip 12. In this case, the topmost bearer wall strip 14 is only very briefly extended beyond the topmost ceiling strip 13 so that in the main it has the task of fixing the position of the roof assembly 26. Such a roof structure is indeed more expensive and more complicated than that shown in FIG. 7*a*, but on the other hand it does provide greater stability. In FIG. 7*c* are shown rafters 27 which are disposed between the topmost ceiling strip 13 and the extended bearer wall strip 14 of the outermost frame part 12. The other roof areas can thereby easily be formed by (not shown) beams which are disposed between the terminal blocks 3 of the topmost bearer wall strips 14 and the terminal blocks 3 of the topmost ceiling strips 13. In the present structure as shown in FIG. 7*c* there are furthermore, approximately in the middle, frame parts 12 of which the two topmost ceiling strips 13 are shorter than the others so that a simple access is created to the large and spacious roof of the structure. In the case of the structure according to FIG. 7*d*, only the bearer wall strips 14 of the outermost frame parts 12 are extended beyond the topmost ceiling strip 13 for mounting of the roof rafters 27. In the case of the other frame parts disposed between these outer frame parts, the topmost ceiling strip 13 forms the outermost closure. Consequently, a spacious roof floor is created which can be favourably developed as dwelling space. Between the terminal blocks 3 of the free standing bearer wall strips 14 there is a beam 28 which supports the other parts of the roof. FIGS. 7*e* and 7*f* show roof structures which are easily formed in that the topmost ceiling strips 13 form approximately in their centre an angle with respect to one another. This angle is achieved in that the surfaces of the topmost nodal block 1 which are directed towards the ceiling strip are constructed at an angle to one another. Since the block and/or beam-shaped component elements 10 bear on these faces of the nodal blocks 1 and are drawn tightly against these latter, the two halves of the topmost ceiling strip are at an angle to one another which corresponds to the angle of inclination of the faces of the topmost nodal component element 1. This construction has the advantage that now, upon erection of the structure, the roof of the structure is at the same time also provided, so that there are no further delays.

FIGS. 8*a* to 8*c* show basic frame shapes 20 which in conventional manner consist of a bearer wall strip 14 and two ceiling strips 13. The ceiling strips 13 are in some cases constructed as tapering from the bearer wall strip 14 outwards. The ceiling strips can therefore advantageously be adapted to the pattern of bending moments in the ceiling strip so that a substantial reinforcement is effected. According to the construction of the individual ceiling strips, it is thereby possible for two basic frame shapes 20 to have the free ends of the ceiling strips moved within one another so that the structural assembly or structures are variable in their spatial size. FIGS. 8*d* to 8*f* show frame parts derived from the basic frame shape 21. As can be seen particularly from FIG. 8*d*, a roof construction can also be produced by the topmost ceiling strip being constructed with its topmost face falling from the nodal component element 1 to the terminal component element 3. Since the lowest ceiling strip always has to accommodate the greatest loading, it may, as illustrated in FIG. 8*e*, be favourable for this to be reinforced in accordance with the pattern of moments.

Figure 9A:
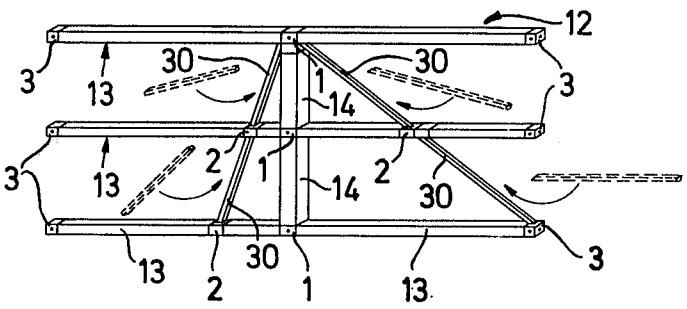
Figure 9B:
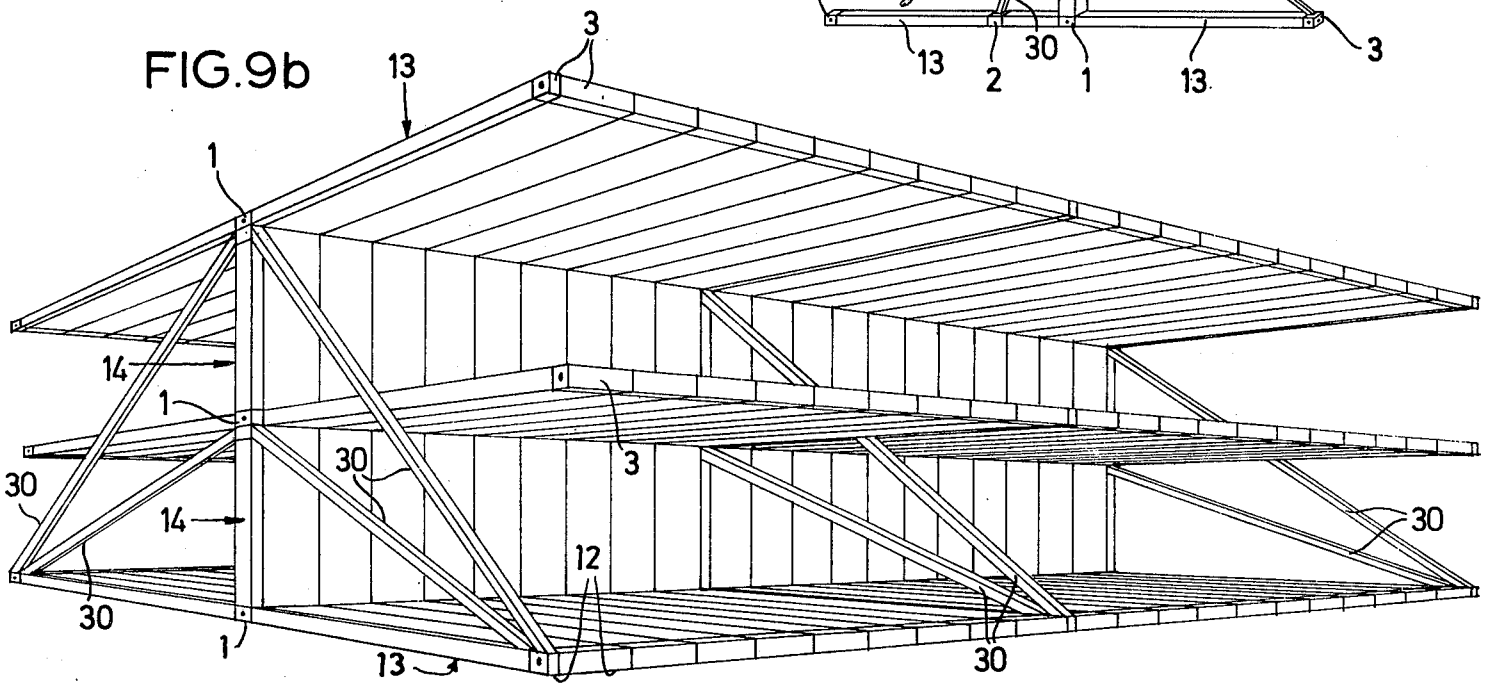

FIGS. 9*a* and 9*b* show diagonal strips 30 which are disposed for reinforcement purposes within the frame parts 12. FIG. 9*a* thereby shows only a frame part while 9*b* shows a structure in which the outer and a middle frame part 12 is provided with diagonal strips 30. The diagonal strips 30 may be of different lengths and either extend from terminal blocks 3 to connecting blocks 2 to nodal blocks 1 and be braced with pull ropes 6, or they may also, as can be seen particularly in FIG. 9*b*, be produced as independent parts and be disposed between individual component elements of a frame part 12. These diagonal strips 30 provide a substantial reinforcement of a frame part or of a structure.

Figure 10A:
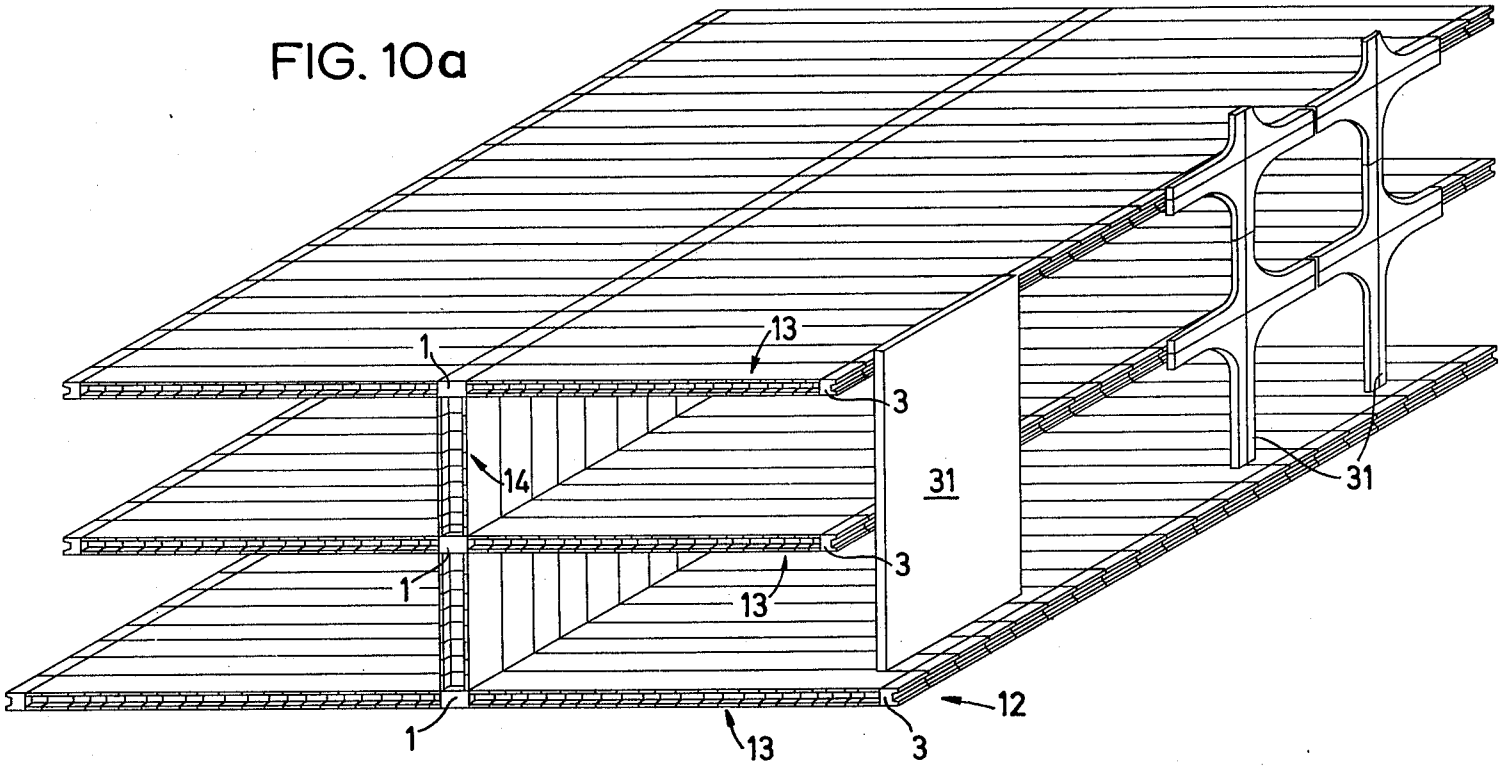
Figure 10B:
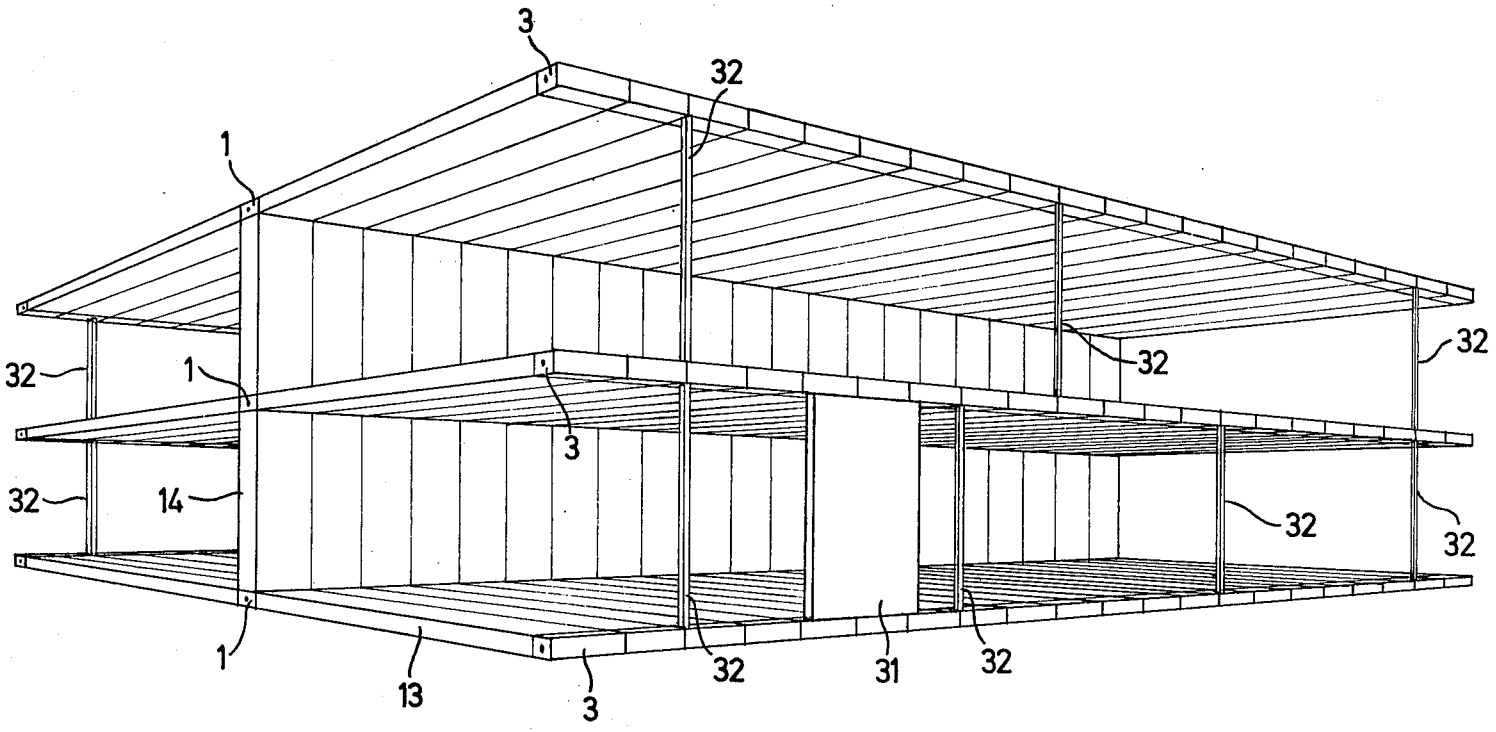
Figure 11A:
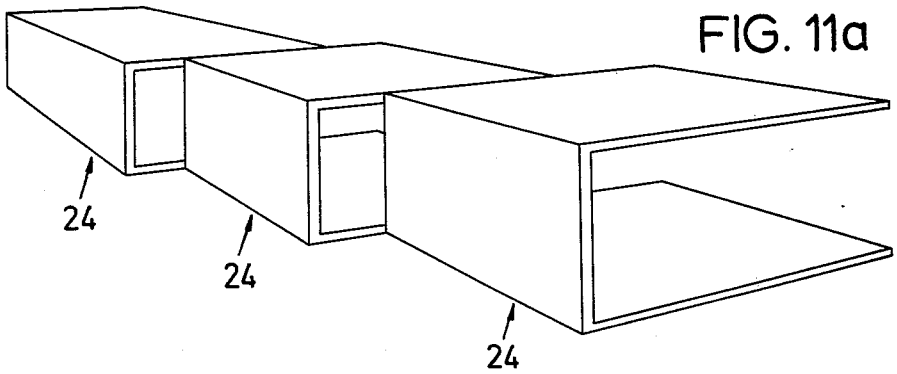
Figure 11B:
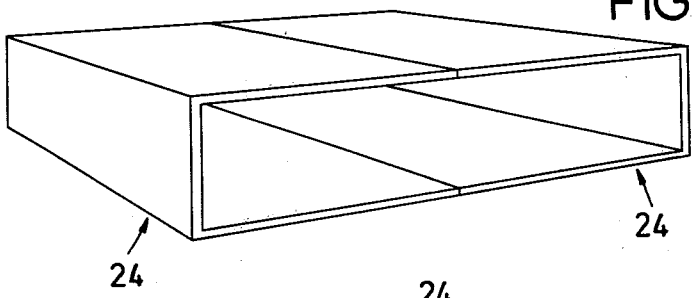
Figure 11C:
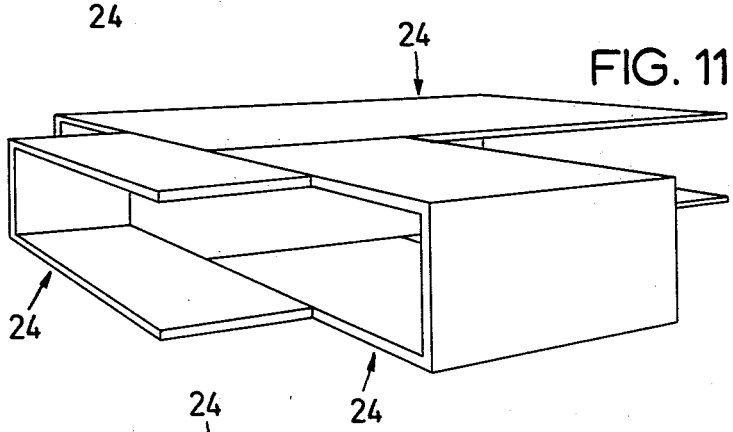
Figure 11D:
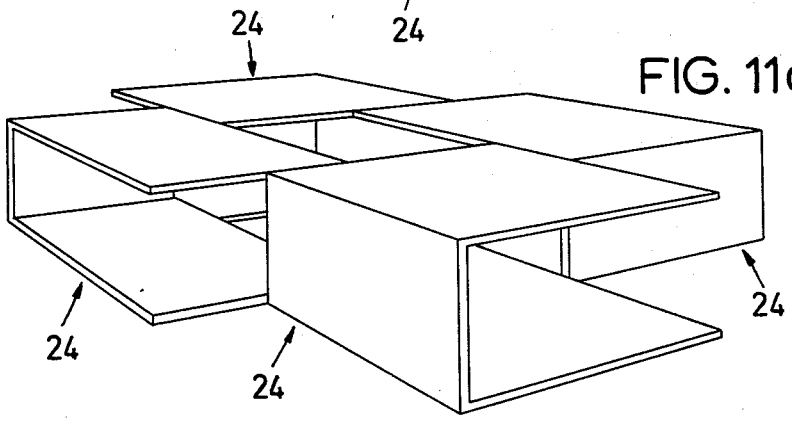
Figure 11E:
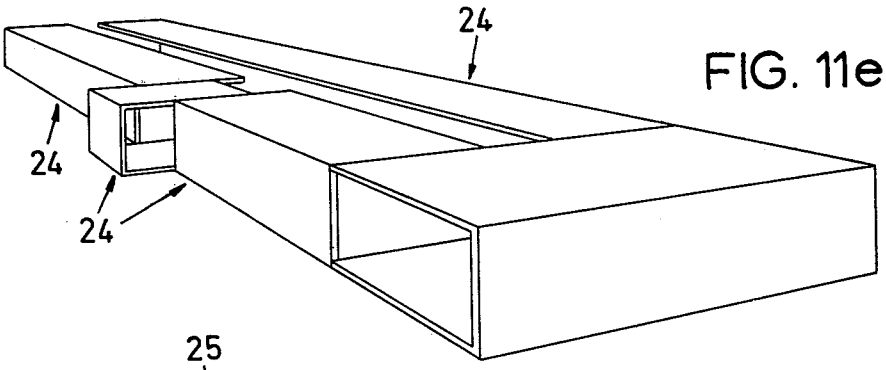
Figure 11F:
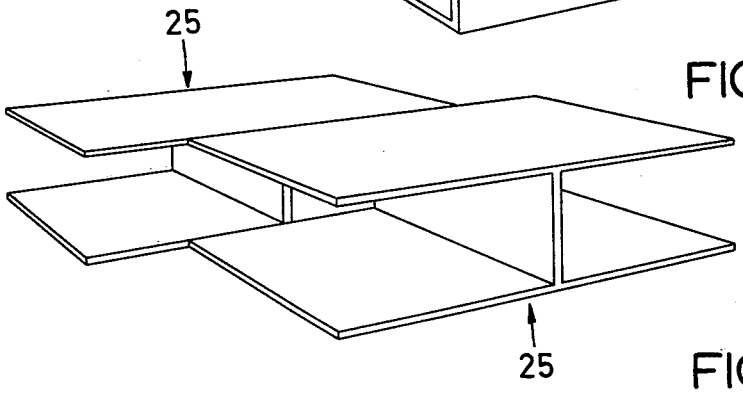
Figure 11G:
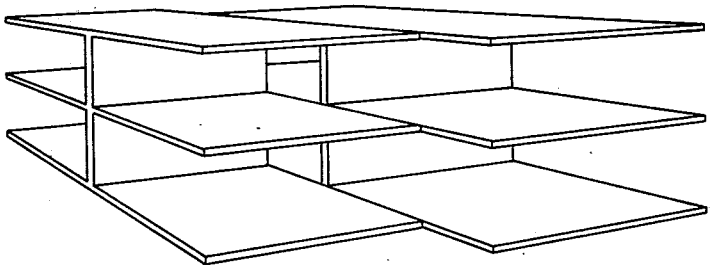
Figure 11H:
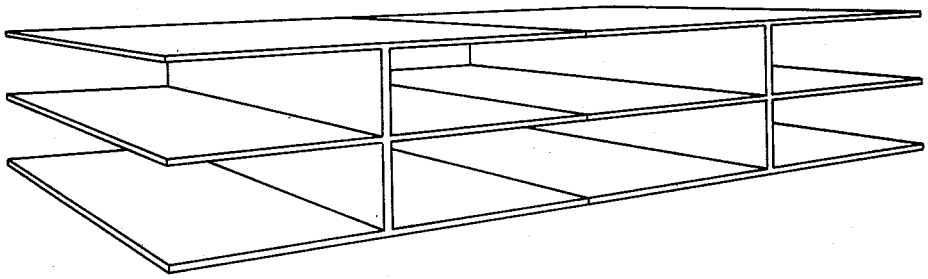

FIGS. 10*a* and 10*b* show facade panels or facade cladding 31 which, as shown in FIG. 10*a*, are braced on extended ceiling strips 13 which are disposed on the ground and which are mounted on the other ceiling strips. These facade panels or facade claddings 31 serve only for the external cladding of the structure and have no bearing properties. In FIG. 10*b*, there are in the individual ceiling strips 13 supports 32 which serve as fixing elements for the facade panels 31. Attention is drawn to the fact that the supports 32 may also be constructed to accommodate a loading. This is important if the ceiling strips 13 extend particularly far and if the structures involved have a particularly high ceiling loading as is the case for example in the case of exhibition hangers, schools and archives.

FIG. 11*a* to 11*h* show structures which are composed of individual structural assemblies 24 and 25 comprised substantially of basic frame shapes 20 and 21. The result is very favourable possibilities of development which permit both of large rooms as well as also favourable sub-divisions of the structures. Attention is drawn to the fact that the projecting ceiling strips 13 can without difficulty achieve lengths of 6 m so that for example in the case of the juxtaposition of the terminal block 3 of different assemblies, it is possible to achieve substantial freely supported rooms.

Figure 12:
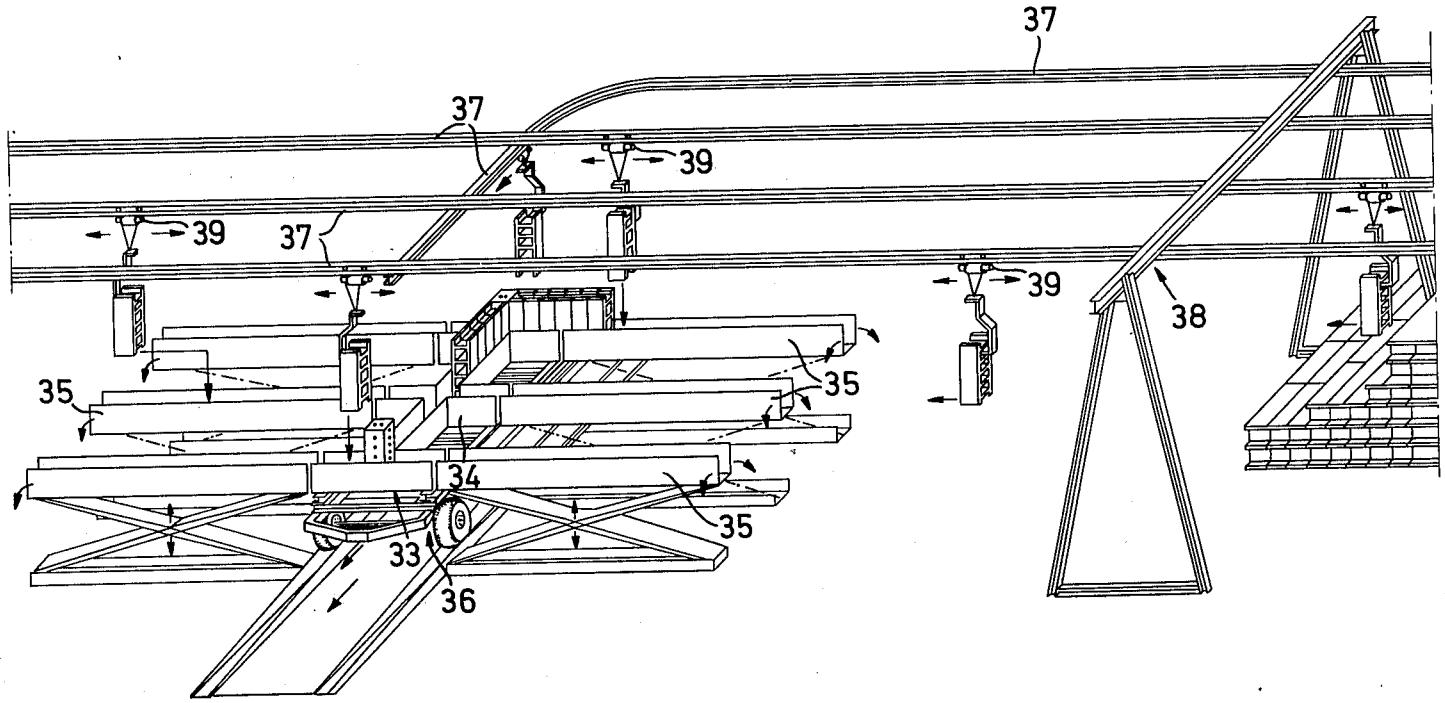

FIG. 12 shows a mould 33 for producing a frame part 12 which consists of a middle part 34 and side parts 35. In this case, the side parts 34 can be lowered while the middle part is mounted on a vehicle 36. Disposed above the side parts 35 and the middle part 34 and aligned therewith there are rails 37 which are carried by mountings 38. Movably mounted on the rails 36 are overhead cranes 39 on which there is block and tackle for accommodating structural elements. By means of the block and tackle of the overhead cranes 39, the structural elements are picked up and carried along the rails until they are above the mould 33 where they are deposited alongside the previous block. In this way, the individual component elements can be rapidly and easily combined into one frame part and then braced with respect to one another. After completion of the frame part, the side parts 35 are lowered and the vehicle 36 is moved to the building site. There, by operating a hydraulic cylinder of the vehicle 36, the middle part is set upright and disposed either as a first frame part or alongside already erected frame parts. The frame parts 12 are usually placed on the ground or on foundation strips, being carried on their lowest ceiling strip which serves as a foundation floor, no excessive demands being made of the foundation strips since the frame parts are intended primarily for erection on the levelled earth.

Figure 12A:
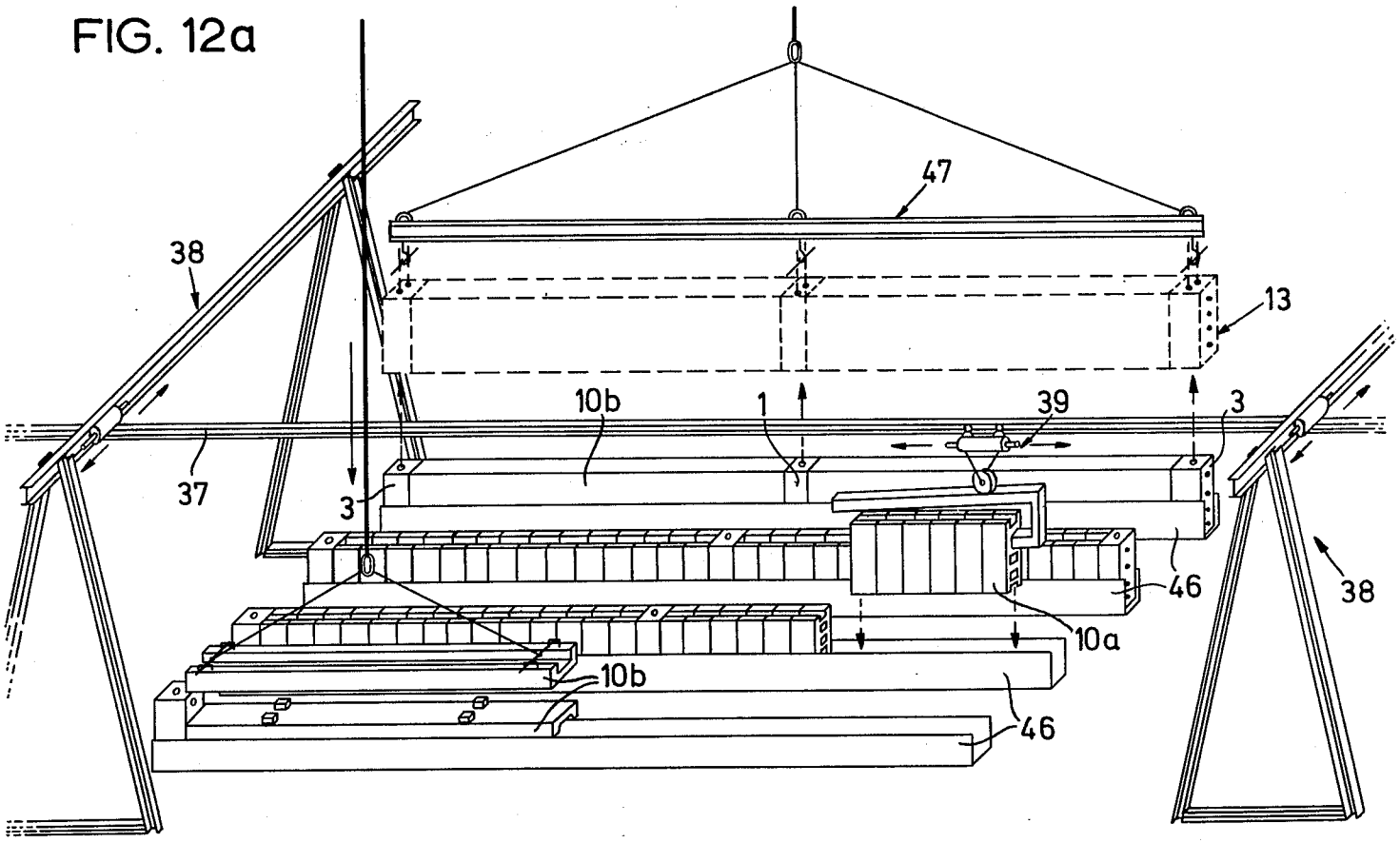

In the case of the production shop shown in FIG. 12*a*, reference numeral 46 is used to denote ceiling strip moulds above which there is, according to FIG. 12, a rail 37 carried by supports 38. The rail 37 projects beyond the supports 38 to carry structural elements and is mounted to move in the supports 38 so that it can be moved to any ceiling strip mould 46. Mounted on the rail 37 is an overhead crane 39 with a block and tackle so that structural elements of desired form can be picked up and placed in the mould. Disposed in the ceiling strip moulds 46 are terminal blocks 3, beam and block-shaped elements 10 and nodal block 1. After bracing of a ceiling strip, this latter is lifted by a block and tackle 47.

Figure 13:
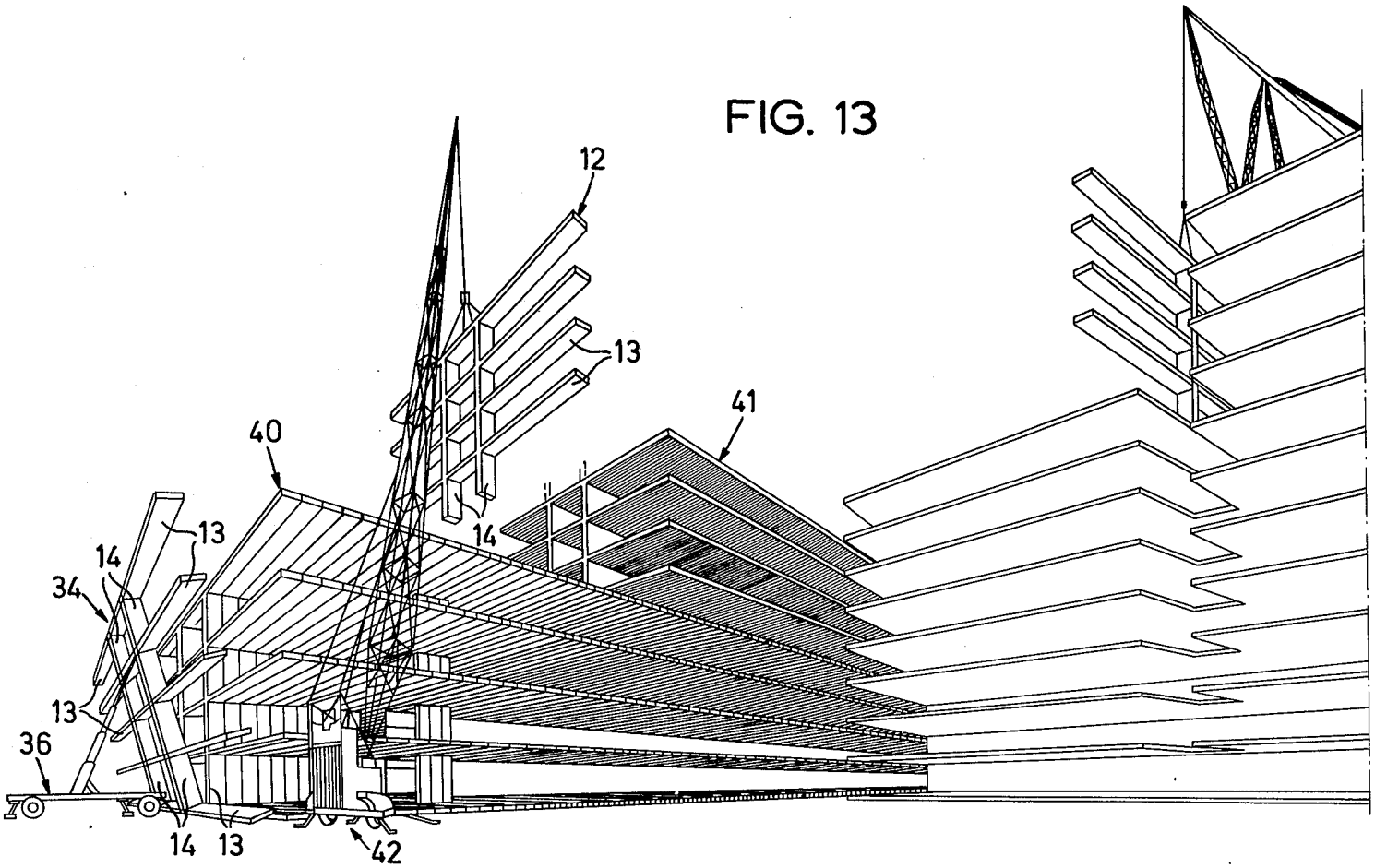

FIG. 13 shows a major building site on which the vehicle 36 is shown which carries the middle part 34. In contrast to FIG. 12, the middle part 34 has two bearer wall strips 14 and a relatively large number of ceiling strips 12. After provision of a structure assembly 40, a second structure assembly 41 is placed thereon. These frame parts 12 are lifted by a crane 42 and are lowered onto the first structure assembly 40. As is not shown in FIG. 13, shortly before lowering of the frame part 12, the pull ropes projecting from the lower frame part are inserted into the bearer wall strips 14 of the upper frame part 12 after which the lower and upper frame parts are braced with one another. The horizontal bracing of the frame part between themselves is effected in conventional manner.

Figure 13A:
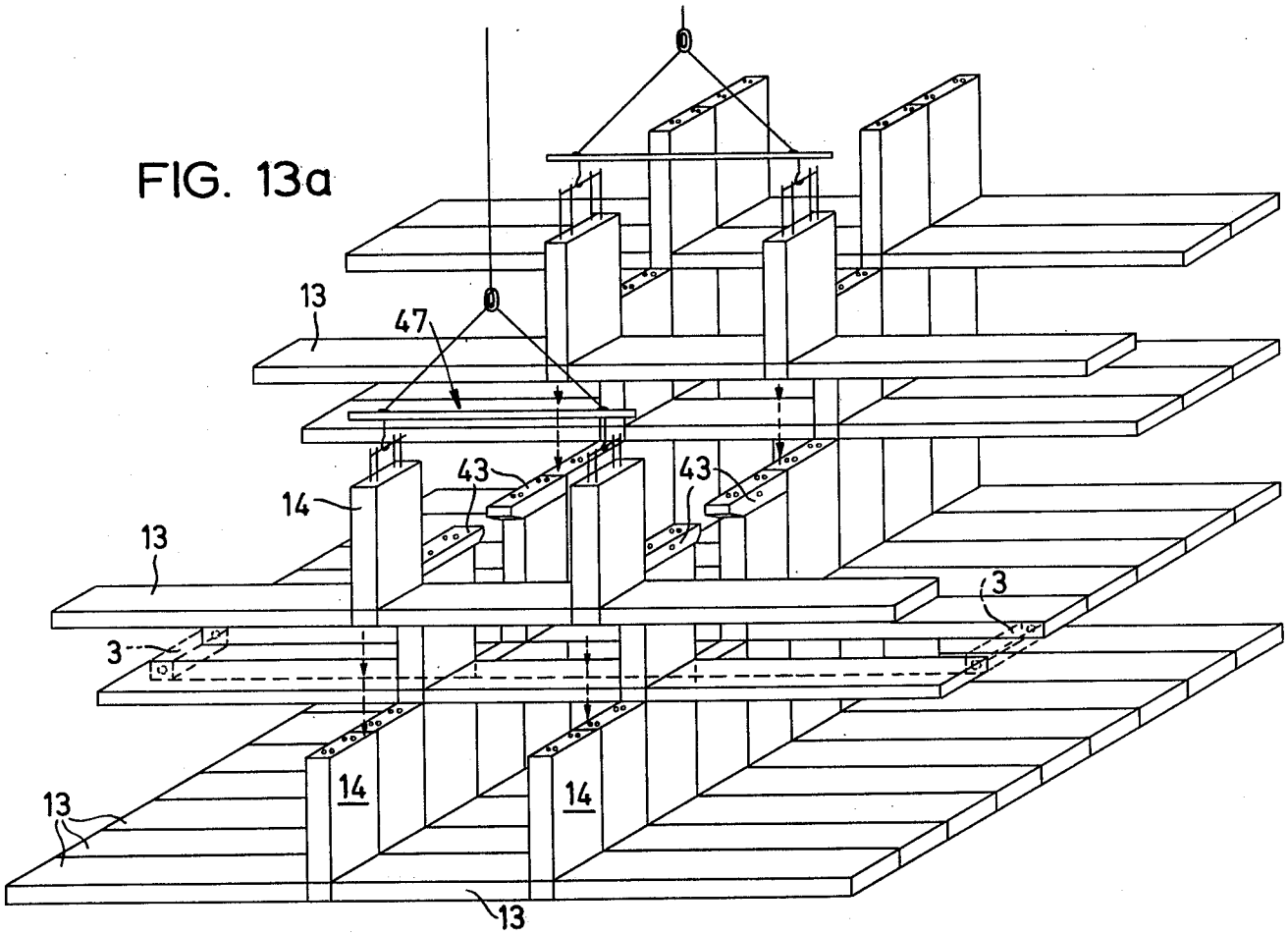

FIG. 13*a* shows modifications of the basic frame shape 23 one alongside another. A block and tackle 47 deposits on these frame parts which have free bearer wall strips 14 identical frame parts. The depositing and connection of the frame parts is effected in accordance with the comments with respect to FIG. 13. At one point of the structure assembly, a frame part is omitted. The bearer walls disposed alongside it have thereby in FIG. 14 console blocks 43 which are to be explained in greater detail hereinafter.

Figure 13B:
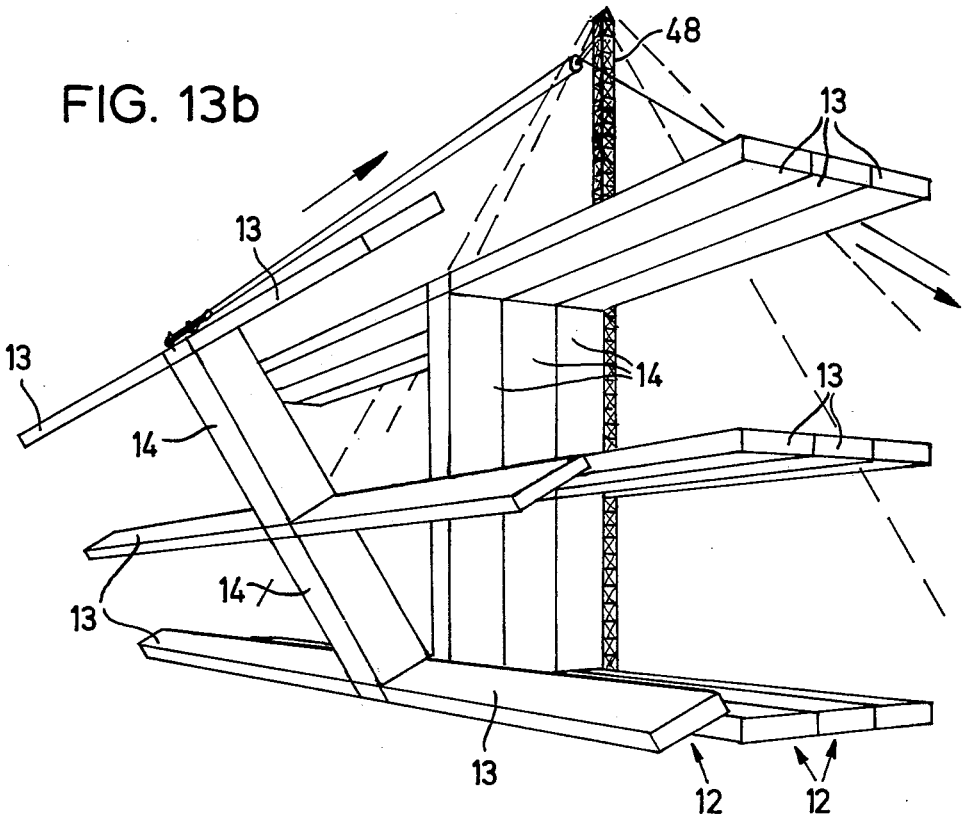

In FIG. 13*b*, disposed alongside already erected frame parts 12 is a lifting mast 48 which on the side of the frame part 12 which is remote from it, is pulling up a further frame part 12.

Figure 14:
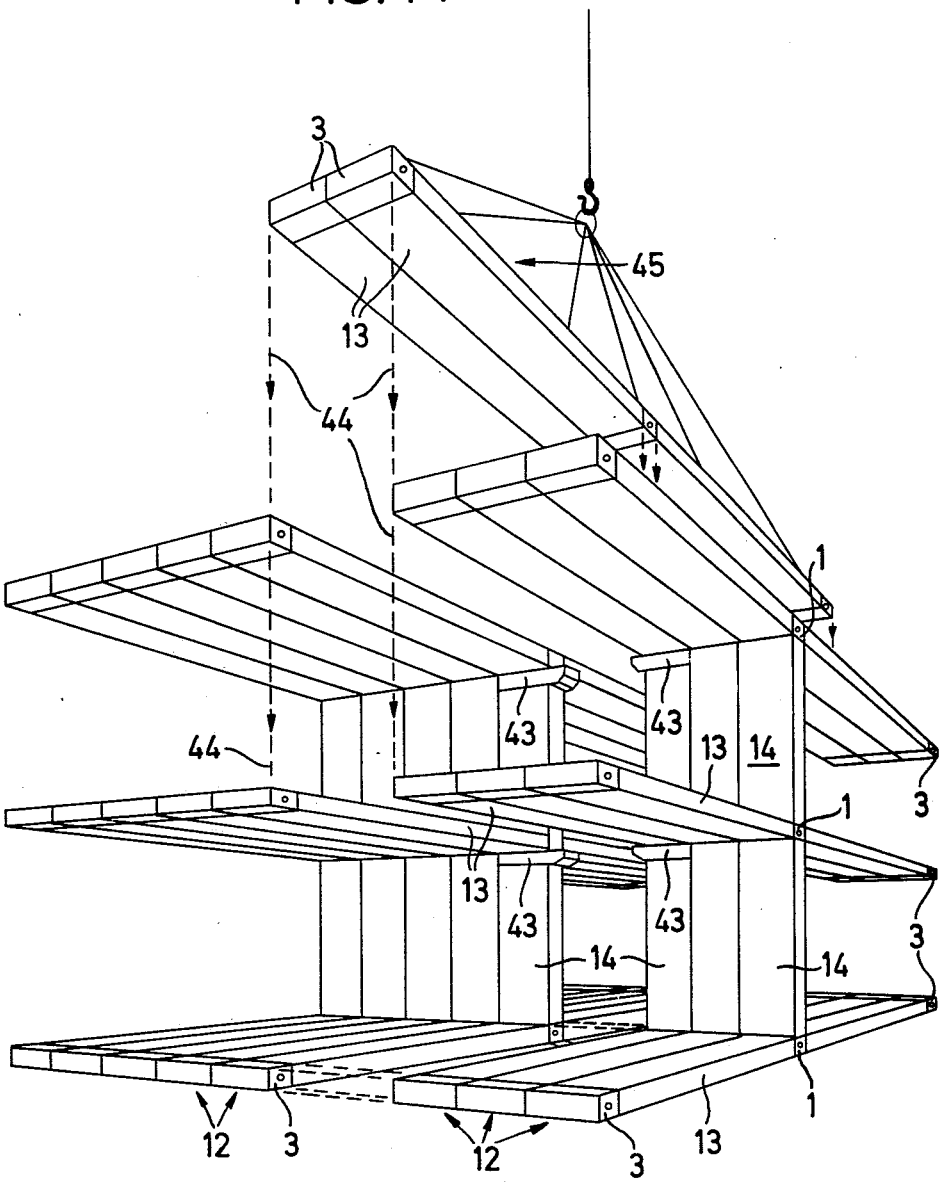
FIG. 14 shows a structural assembly of skeletal construction, in which adjacent frame parts have console blocks to receive ceiling strips.

FIG. 14 shows a plurality of frame parts 12, two groups of frame parts being erected at a distance from each other. The mutually adjacent frame parts have in the bearer wall strips 14 below the ceiling strips 13 console elements 43 which project from the bearer wall strips. As is indicated by the broken lines 44 an intermediate part 45 consisting of two ceiling strips 13 is placed on these console elements, the console elements 43 supporting this intermediate part. Afterwards, the intermediate part 45 is horizontally braced by extensioning wires 7 together with the other ceiling strips 13, so that a flat ceiling or a flat floor of the structure is produced. The recesses in the bearer wall strips are ideal for the incorporation of doors or make ideal openings for corridors or the like.

Figure 15:
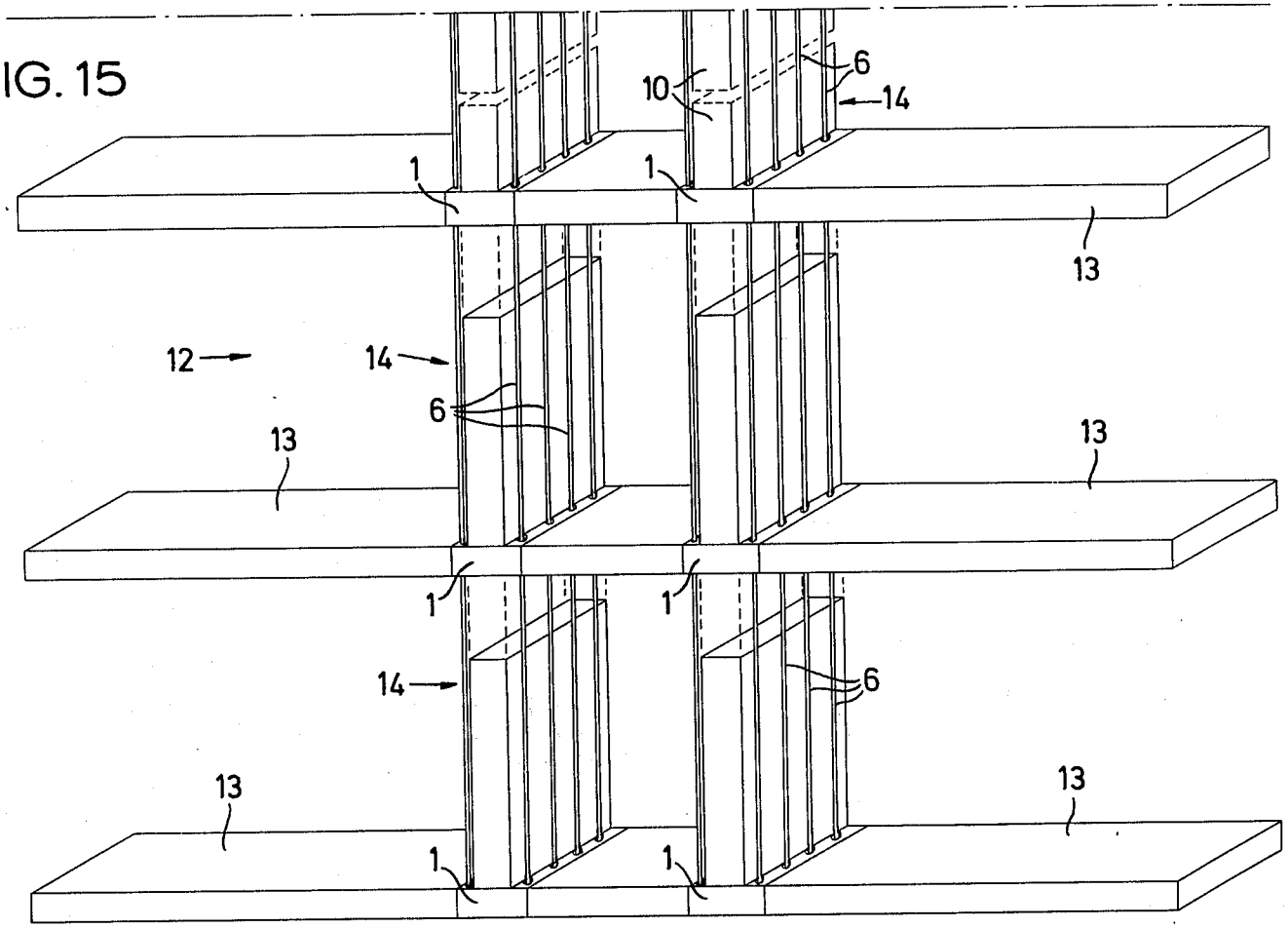
FIG. 15 shows a frame part in which the nodal component elements are widened in the direction of the ceiling strips and in which the pull ropes of the bearer wall strips are disposed on the outside.

FIG. 15 shows a frame part 12 of which the nodal elements 1 are widened in the direction of the ceiling strip. In that part of the nodal element 1 which projects beyond the bearer wall strips 14, there are holes 8 through which the pull rope 6 extends. Thus, it is true that the pull ropes 6 project beyond the component elements 10 of the bearer wall strips 14 but this area may however easily be included. The essential advantage of this construction lies however in the fact that when ceiling strips 13 are placed one on another with and without bearer wall strips 14, the pulling ropes 6 do not have to be threaded in prior to deposition, but can after deposition easily be inserted into the nodal structural elements 1 of the ceiling strips 13 disposed above.

What is claimed is:

1. A structure comprising a plurality of frame parts, each frame part being self-supporting and including interconnected vertical and horizontal strips, a nodal element at the intersection between each vertical and horizontal strip, a terminal element at each end of each vertical and horizontal strip, and at least one block in each vertical and horizontal strip having a length equal to the spacing between said nodal element and one of said terminal elements, said frame parts being arranged in alignment, tension wires for binding said frame parts together so that said aligned vertical strips form a bearing wall of the structure and said aligned horizontal strips form a ceiling of the structure, the lowermost aligned horizontal strips forming the foundation floor of the structure, pull ropes for binding together said vertical and horizontal strips of each frame part, and an anti-corrosive coating covering each rope and wire, the uppermost nodal element of said vertical strip having faces inclined at an acute angle to the vertical, so that said uppermost horizontal strips are correspondingly angled, and each horizontal strip tapering from the vertical strip which it intersects toward its free end, so that at least one of the upper and lower faces of each horizontal strip extends at an acute angle to the horizontal.

2. A structure as defined in claim 1 including a nodal element at the intersection between each vertical and horizontal strip, and a terminal element at each end of each vertical and horizontal strip, each of said nodal and terminal elements having holes for accommodating tension wires and pull ropes.

3. A structure as defined in claim 1 wherein each of said terminal blocks has a recess for receiving rope and wire stressing elements.

4. A structure as defined in claim 2 including a connector element in each of said vertical and horizontal strips between said nodal and terminal elements, said connector element having holes for accommodating ropes and wires.

5. A structure as defined in claim 4 wherein said nodal element, terminal element, and connecting element are solid blocks.

6. A structure as defined in claim 1 wherein said blocks are hollow.

7. A structure as defined in claim 4 wherein each of said vertical and horizontal strips includes an I-beam-shaped block having a length equal to the spacing between said nodal element and one of said terminal and connector elements.

8. A structure as defined in claim 1 wherein each of said vertical and horizontal strips comprises a plurality of aligned blocks, and pull ropes for binding said aligned blocks together.

9. A structure as defined in claim 1 wherein said pull ropes are arranged along said vertical strips in a pattern corresponding to the bending moments to which the ceiling of the structure is subjected.

10. A structure as defined in claim 1 wherein the pull ropes of said vertical and horizontal strips are completely independent of each other.

11. A structure as defined in claim 1 wherein said vertical and horizontal strips of each frame part are arranged in the shape of a horizontal "U".

12. A structure as defined in claim 1 wherein said vertical and horizontal strips of each frame part are arranged in the shape of a horizontal "H".

13. A structure as defined in claim 1 wherein each of said frame parts includes two horizontally spaced vertical strips between each two successive horizontal strips, the horizontal strips projecting in cantilever fashion beyond both vertical strips.

14. A structure as defined in claim 1 wherein said vertical strip extends upwardly beyond the uppermost horizontal strip, and a roof assembly supported at least in part by the upward extension of said vertical strip.

15. A structure as defined in claim 4 including a diagonally arranged reinforcing strip in some of said frame parts, said reinforcing strip being between a nodal element of a horizontal strip and one of said connector and terminal elements of a different horizontal strip.

16. A structure as defined in claim 1 wherein a plurality of frame parts are bound together into a structural assembly, and the structure comprises a plurality of structural assemblies bound together.

17. A structure as defined in claim 1 wherein said horizontal strip is provided with means for receiving one of roof, ceiling, and floor coverings.

18. A structure as defined in claim 1 wherein some of said horizontal strips have lengths different from the lengths of some of the other horizontal strips.

19. A structure as defined in claim 2 wherein said nodal elements are wider than the blocks comprising said vertical strips, and including rope accommodating holes in the portions of said nodal elements lying beyond the contour of said blocks.

* * * * *